US009341983B2

(12) United States Patent
Yoshida et al.

(10) Patent No.: US 9,341,983 B2
(45) Date of Patent: May 17, 2016

(54) DEVELOPER ACCOMMODATING UNIT, DEVELOPING DEVICE, PROCESS CARTRIDGE AND IMAGE FORMING APPARATUS

(71) Applicant: CANON KABUSHIKI KAISHA, Tokyo (JP)

(72) Inventors: Masatomi Yoshida, Kawasaki (JP); Kojiro Yasui, Numazu (JP); Masaaki Matsushita, Yokohama (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/149,999

(22) Filed: Jan. 8, 2014

(65) Prior Publication Data

US 2014/0199096 A1 Jul. 17, 2014

(30) Foreign Application Priority Data

Jan. 11, 2013 (JP) ..... 2013-003946

(51) Int. Cl.
*G03G 15/08* (2006.01)
*G03G 21/16* (2006.01)

(52) U.S. Cl.
CPC ..... *G03G 15/0882* (2013.01); *G03G 15/0841* (2013.01); *G03G 15/0868* (2013.01); *G03G 15/0874* (2013.01); *G03G 15/0881* (2013.01); *G03G 21/1676* (2013.01); *G03G 2215/0682* (2013.01); *G03G 2215/0687* (2013.01); *G03G 2215/0875* (2013.01)

(58) Field of Classification Search
CPC ..... G03G 15/0841; G03G 15/0874; G03G 15/0881; G03G 15/0882; G03G 21/1676; G03G 2215/0682; G03G 2215/0687; G03G 2215/0875; G03G 15/0868
See application file for complete search history.

(56) References Cited

U.S. PATENT DOCUMENTS

| | | | | |
|---|---|---|---|---|
| 5,111,976 | A * | 5/1992 | Ban | 222/485 |
| 5,142,335 | A * | 8/1992 | Sakata et al. | 399/106 |
| 5,729,797 | A * | 3/1998 | Okada et al. | 399/120 |
| 6,128,462 | A | 10/2000 | Kato et al. | |
| 6,169,869 | B1 | 1/2001 | Inami et al. | |
| 6,175,703 | B1 | 1/2001 | Nakazono et al. | |
| 6,337,964 | B2 | 1/2002 | Inami et al. | |
| 6,350,503 | B1 * | 2/2002 | Cheatham et al. | 428/40.1 |
| 6,539,190 | B2 | 3/2003 | Oba et al. | |
| 6,681,088 | B2 | 1/2004 | Kanno et al. | |
| 6,782,219 | B2 | 8/2004 | Yoshino et al. | |
| 6,834,173 | B2 | 12/2004 | Yamaguchi et al. | |
| 6,859,629 | B2 | 2/2005 | Miura et al. | |
| 6,898,401 | B2 | 5/2005 | Okano et al. | |
| 6,915,092 | B2 | 7/2005 | Yamaguchi et al. | |

(Continued)

FOREIGN PATENT DOCUMENTS

JP H 4-66980 3/1992

*Primary Examiner* — Ryan Walsh
(74) *Attorney, Agent, or Firm* — Fitzpatrick, Cella, Harper & Scinto

(57) ABSTRACT

A developer accommodating unit for accommodating a developer includes: a flexible container provided with a plurality of openings for permitting discharge of developer. The openings are formed and arranged in a longitudinal direction of the developer accommodating unit. The openings have opening areas such that with respect to the longitudinal direction, the opening area of the opening provided at an end portion is larger than the opening area of the opening provided at a central portion.

17 Claims, 24 Drawing Sheets

(56) References Cited

U.S. PATENT DOCUMENTS

| | | | |
|---|---|---|---|
| 6,947,687 | B2 | 9/2005 | Yamaguchi et al. |
| 6,961,528 | B2 | 11/2005 | Yamaguchi et al. |
| 6,963,706 | B2 | 11/2005 | Morioka et al. |
| 6,978,100 | B2 | 12/2005 | Yasui et al. |
| 6,983,115 | B2 | 1/2006 | Isobe et al. |
| 7,016,626 | B2 | 3/2006 | Yokomori et al. |
| 7,068,965 | B2 | 6/2006 | Yoshino et al. |
| 7,085,516 | B2 | 8/2006 | Kawai et al. |
| 7,116,925 | B2 | 10/2006 | Yamaguchi |
| 7,136,604 | B2 | 11/2006 | Chadani et al. |
| 7,155,137 | B2 | 12/2006 | Yasui et al. |
| 7,184,687 | B2 | 2/2007 | Yamaguchi et al. |
| 7,194,225 | B2 | 3/2007 | Yamaguchi |
| 7,398,040 | B2 | 7/2008 | Yoshida |
| 7,477,865 | B2 | 1/2009 | Yamaguchi et al. |
| 7,519,310 | B2 | 4/2009 | Yamaguchi et al. |
| 7,792,460 | B2 | 9/2010 | Yamaguchi et al. |
| 8,121,519 | B2 | 2/2012 | Yamaguchi et al. |
| 8,577,252 | B2 | 11/2013 | Anan et al. |
| 2009/0245883 | A1* | 10/2009 | Koido ..... G03G 15/0855 399/262 |
| 2011/0170906 | A1 | 7/2011 | Matsushita et al. |
| 2012/0027457 | A1 | 2/2012 | Yamaguchi et al. |
| 2013/0136489 | A1 | 5/2013 | Yamaguchi et al. |
| 2013/0164039 | A1 | 6/2013 | Matsushita et al. |
| 2013/0164040 | A1 | 6/2013 | Matsushita et al. |
| 2013/0336679 | A1 | 12/2013 | Furutani et al. |
| 2013/0343785 | A1 | 12/2013 | Masuzaki et al. |
| 2014/0016961 | A1 | 1/2014 | Yasui et al. |
| 2014/0029974 | A1 | 1/2014 | Uesugi et al. |
| 2014/0064793 | A1 | 3/2014 | Matsuzaki et al. |
| 2014/0072329 | A1 | 3/2014 | Uesugi et al. |
| 2014/0072330 | A1 | 3/2014 | Yoshida et al. |
| 2014/0072331 | A1 | 3/2014 | Matsushita et al. |
| 2014/0072346 | A1 | 3/2014 | Furutani et al. |
| 2014/0079432 | A1 | 3/2014 | Matsuzaki et al. |
| 2014/0199092 | A1 | 7/2014 | Matsushita et al. |
| 2014/0199093 | A1 | 7/2014 | Yoshida et al. |
| 2014/0199094 | A1 | 7/2014 | Matsuzaki et al. |

* cited by examiner

DEVELOPER ACCOMMODATING UNIT, DEVELOPING DEVICE, PROCESS CARTRIDGE AND IMAGE FORMING APPARATUS

FIELD OF THE INVENTION AND RELATED ART

The present invention relates to a developer accommodating unit for accommodating a developer, and a developing device, a process cartridge and an image forming apparatus each including the developer accommodating unit.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like.

Further, the process cartridge refers to a cartridge, prepared by integrally assembling an image bearing member, a developer carrying member and a developer accommodating unit into a unit, detachably mountable to or secured to the image forming apparatus.

Further, the developer accommodating unit is accommodated in the image forming apparatus or the process cartridge. The developer accommodating unit includes a flexible container for accommodating the developer.

In a conventional electrophotographic image forming apparatus using the electrophotographic image forming process, a cartridge type in which consumables are integrally assembled into a cartridge and this cartridge is detachably mountable to the image forming apparatus is employed.

As this cartridge, the process cartridge prepared by integrally assembling, e.g., an electrophotographic photosensitive member and a process means actable thereon into a unit, and the developer accommodating unit in which the developer is accommodated have been known.

In such a cartridge, as shown in FIG. 28, an opening provided to a developer accommodating frame 31 for accommodating a developer (toner, carrier, etc.) is sealed with a toner seal 32 as a sealing member. Further, a type in which a bonding portion 33 of the toner seal 32 is peeled off during use to unseal thereby to enable supply of the developer has been widely used.

Further, in order to solve a problem such that the developer is scattered in the cartridge in a developer filling step during manufacturing of the cartridge, a constitution in which a deformable developer accommodating unit is used has been proposed (Japanese Laid-Open Patent Application (JP-A) Hei 04-69980). An object of this proposed is to improve operativity of the supply of the developer and to reduce a cost of a developer supplying device by preventing scattering of the developer into the process cartridge.

However, in the case where the developer is accommodated in the deformable developer accommodating container described in JP-A Hei 4-66980, the opening of the deformable developer accommodating container is pulled together with the toner sealing during unsealing, so that there is a fear that the opening is largely deformed and thus it is difficult to unseal the opening.

Further, in the constitution described in JP-A Hei 4-66980, at longitudinal end portions, there is a fear that a discharge amount per unit time is smaller than at a longitudinal central portion and thus a discharge amount distribution with respect to the longitudinal direction of the container becomes nonuniform. In addition, in the case where the developer remaining in the container is small, at the longitudinal end portions, the discharge amount per unit time is larger than at the longitudinal central portion, and therefore there is a fear that also in this case, the discharge amount distribution with respect to the longitudinal direction of the container becomes nonuniform.

As described above, when the discharge amount distribution of the developer with respect to the longitudinal direction of the developer accommodating container becomes nonuniform, there is a fear that image non-uniformity is generated over an image forming region.

SUMMARY OF THE INVENTION

A principal object of the present invention is to provide a developer accommodating unit capable of causing a discharge amount of a developer with respect to a longitudinal direction of a developer accommodating container to approach a uniform distribution and in addition, even in the case where the developer remaining in the container becomes small in amount, capable of causing the discharge amount of the developer with respect to the longitudinal direction of the container to approach the uniform distribution. That is, an object of the present invention is to provide a developer accommodating unit capable of reducing a degree of generation of image non-uniformity over an image forming region by causing the developer discharge amount distribution with respect to the longitudinal direction of the container to approach the uniform distribution over a general period from start of use of the developer accommodating unit until the developer accommodating unit reaches the end of a lifetime thereof.

According to an aspect of the present invention, there is provided a developer accommodating unit for accommodating a developer, comprising: a flexible container provided with a plurality of openings for permitting discharge of developer, wherein the openings are formed and arranged in a longitudinal direction of the developer accommodating unit, and wherein the openings have opening areas such that with respect to the longitudinal direction, the opening area of the opening provided at an end portion is larger than the opening area of the opening provided at a central portion.

According to another aspect of the present invention, there is provided a developer accommodating unit for accommodating a developer, comprising: a flexible container provided with an opening for permitting discharge of developer, wherein the opening is formed along a longitudinal direction of the developer accommodating unit, and wherein in the opening has a width, with respect to a direction crossing the longitudinal direction, larger at an end portion with respect to the longitudinal direction than at a central portion with respect to the longitudinal direction.

These and other objects, features and advantages of the present invention will become more apparent upon a consideration of the following description of the preferred embodiments of the present invention taken in conjunction with the accompanying drawings.

Figure 6:
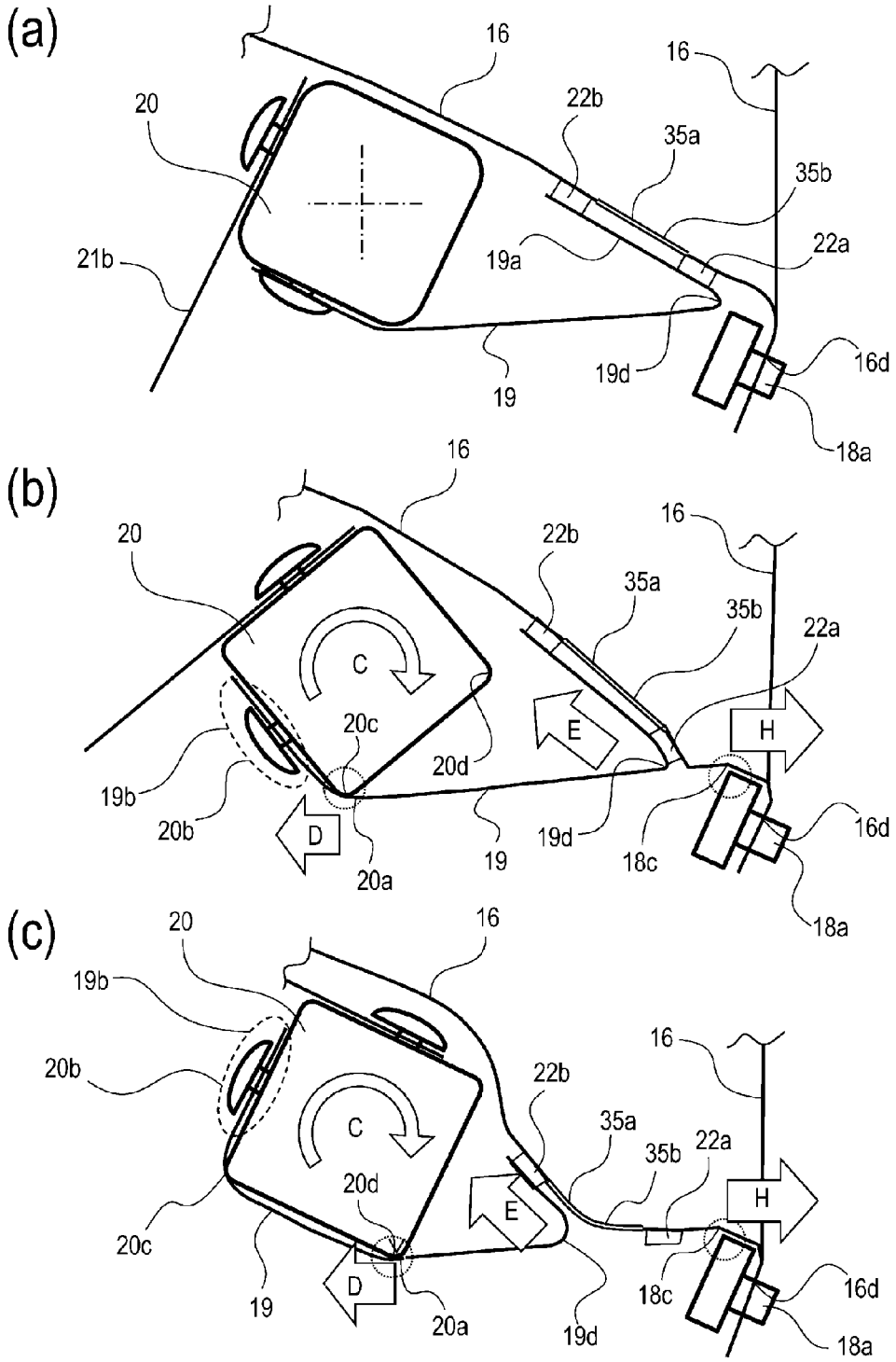
Figure 7:
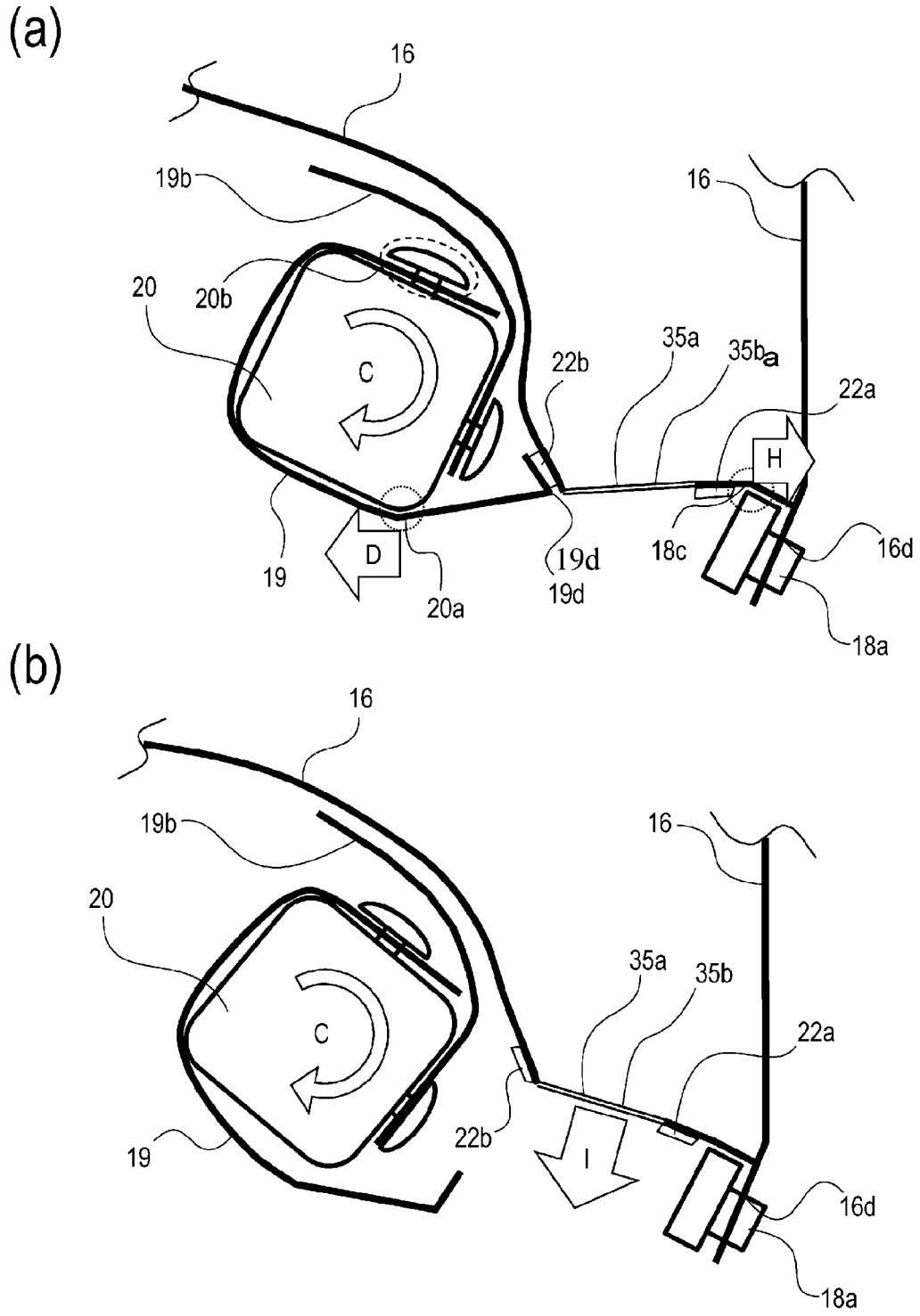

Parts (a), (b) and (c) of FIG. 6, and (a) and (b) of FIG. 7 are sectional views for illustrating a process of unsealing the discharging portion in Embodiment 1 of the present invention.

Figure 8:
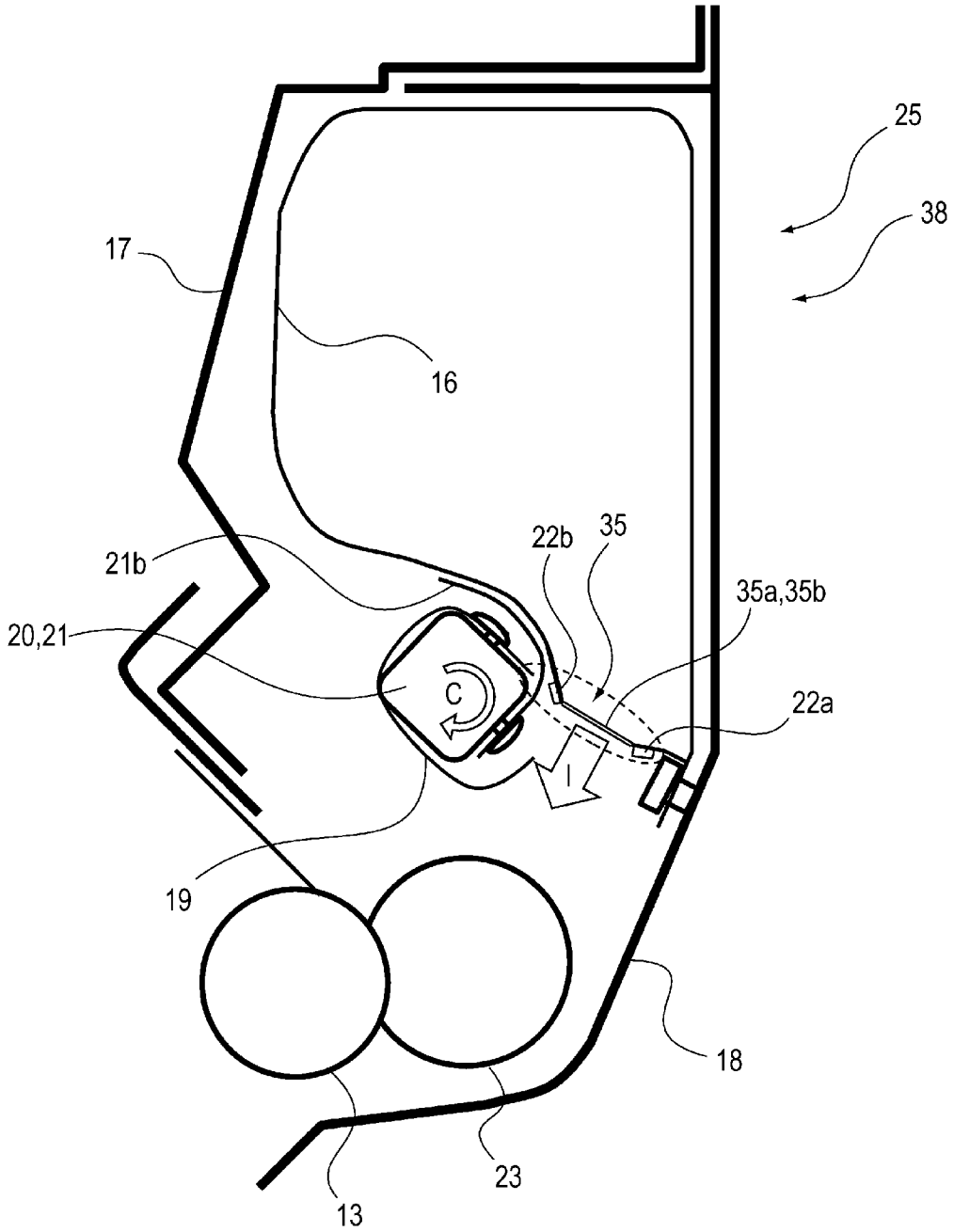

FIG. 8 is a sectional view of the developer accommodating unit after the unsealing in Embodiment 1 of the present invention.

Figure 9:
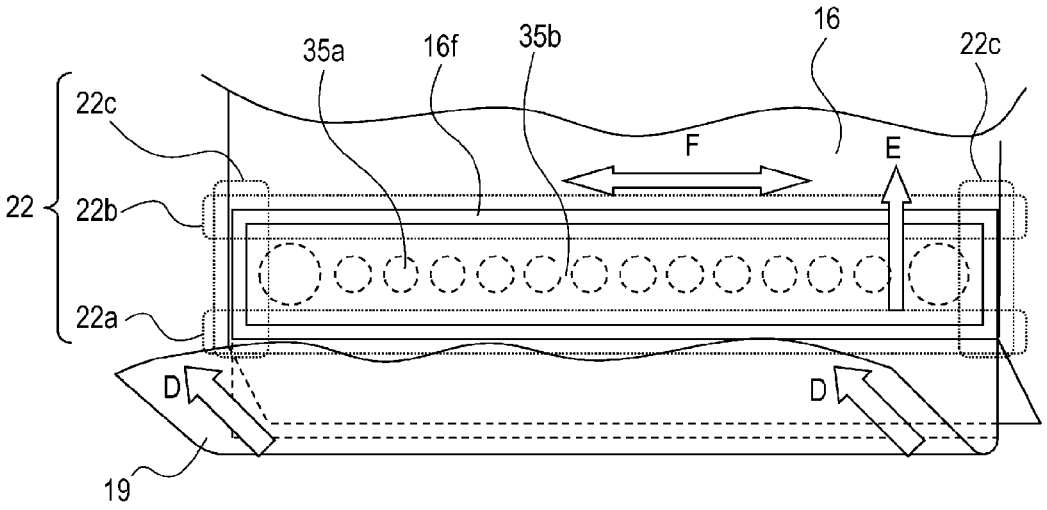

FIG. 9 is an illustration of the developer accommodating container before unsealing in Embodiment 1 of the present invention.

Figure 10:
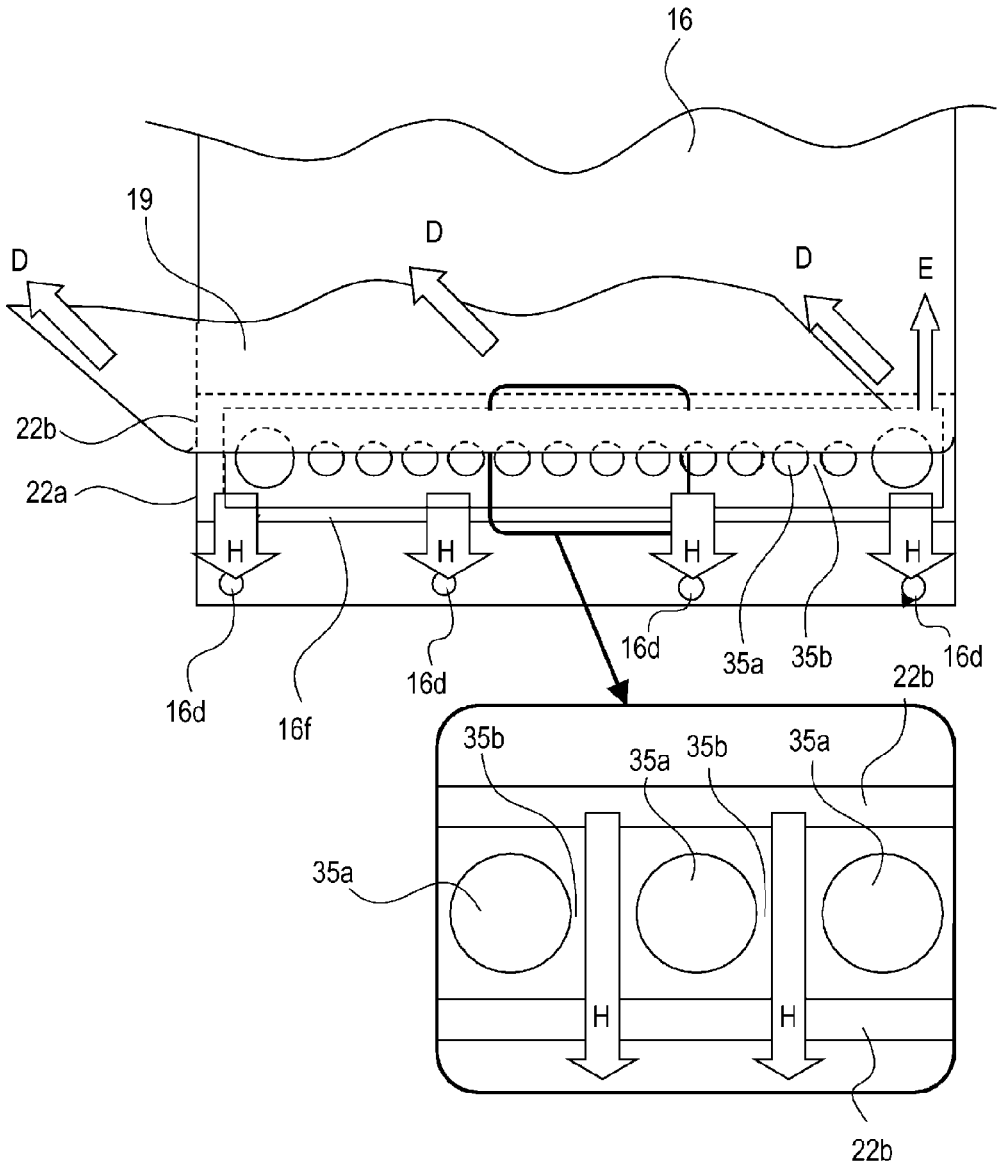

FIG. 10 is an illustration of the developer accommodating container in which the discharging portion is unsealed in midstream in Embodiment 1 of the present invention.

Figure 11:
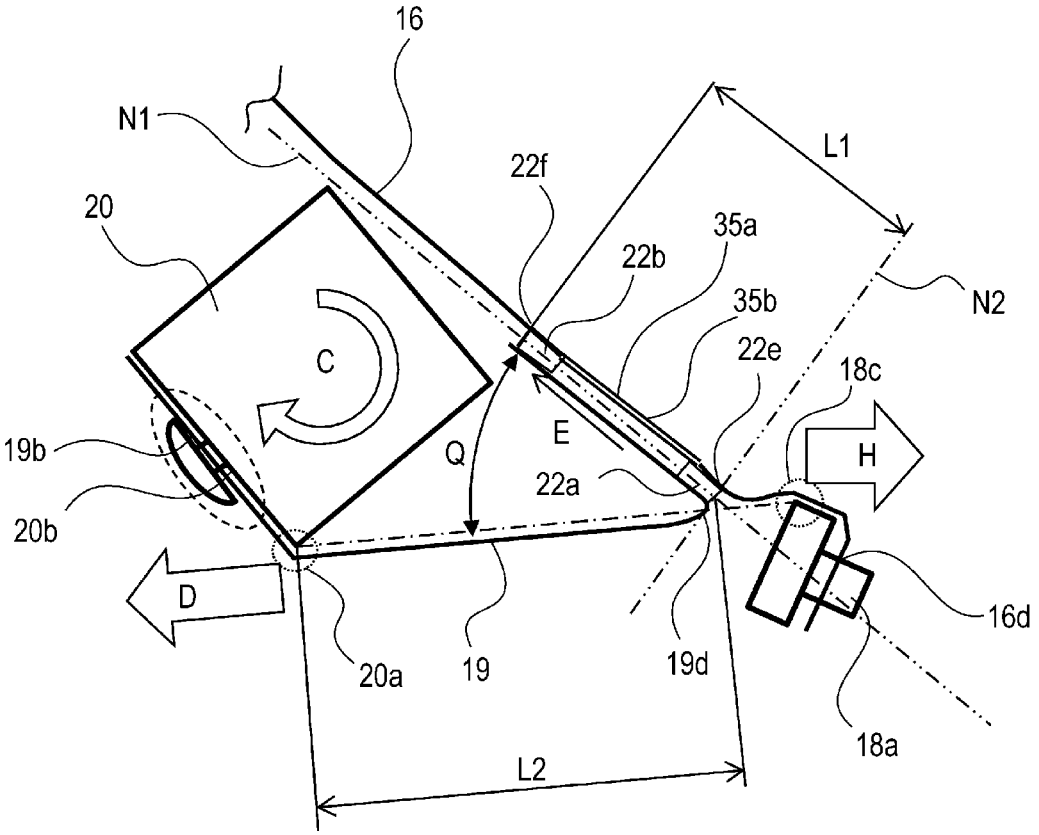

FIG. 11 is a sectional view for illustrating the discharging portion in Embodiment 1 of the present invention.

Figure 12:
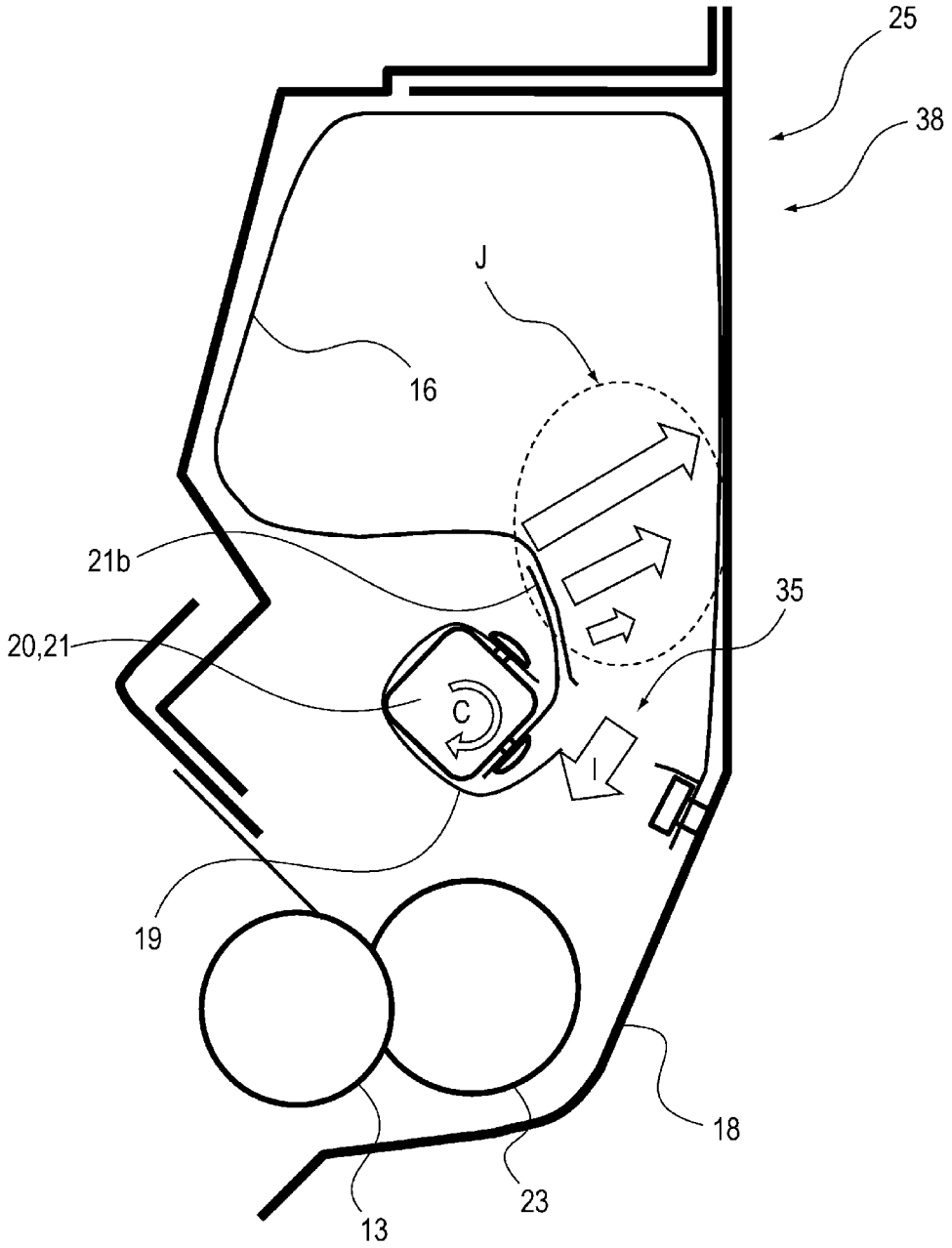
Figure 13:
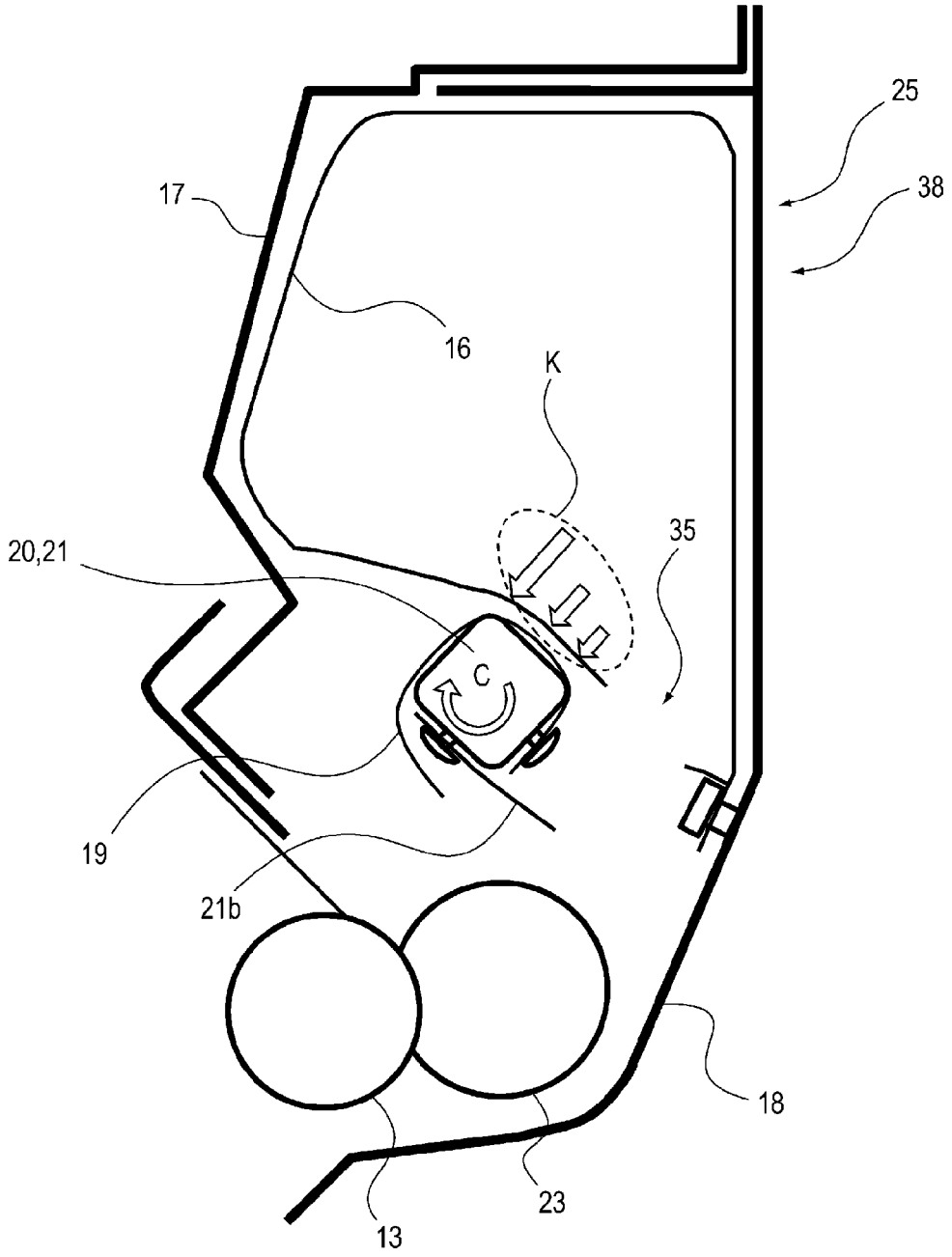

FIG. 12 and FIG. 13 are sectional views of the developer accommodating unit in Embodiment 1 of the present invention.

Figure 14:
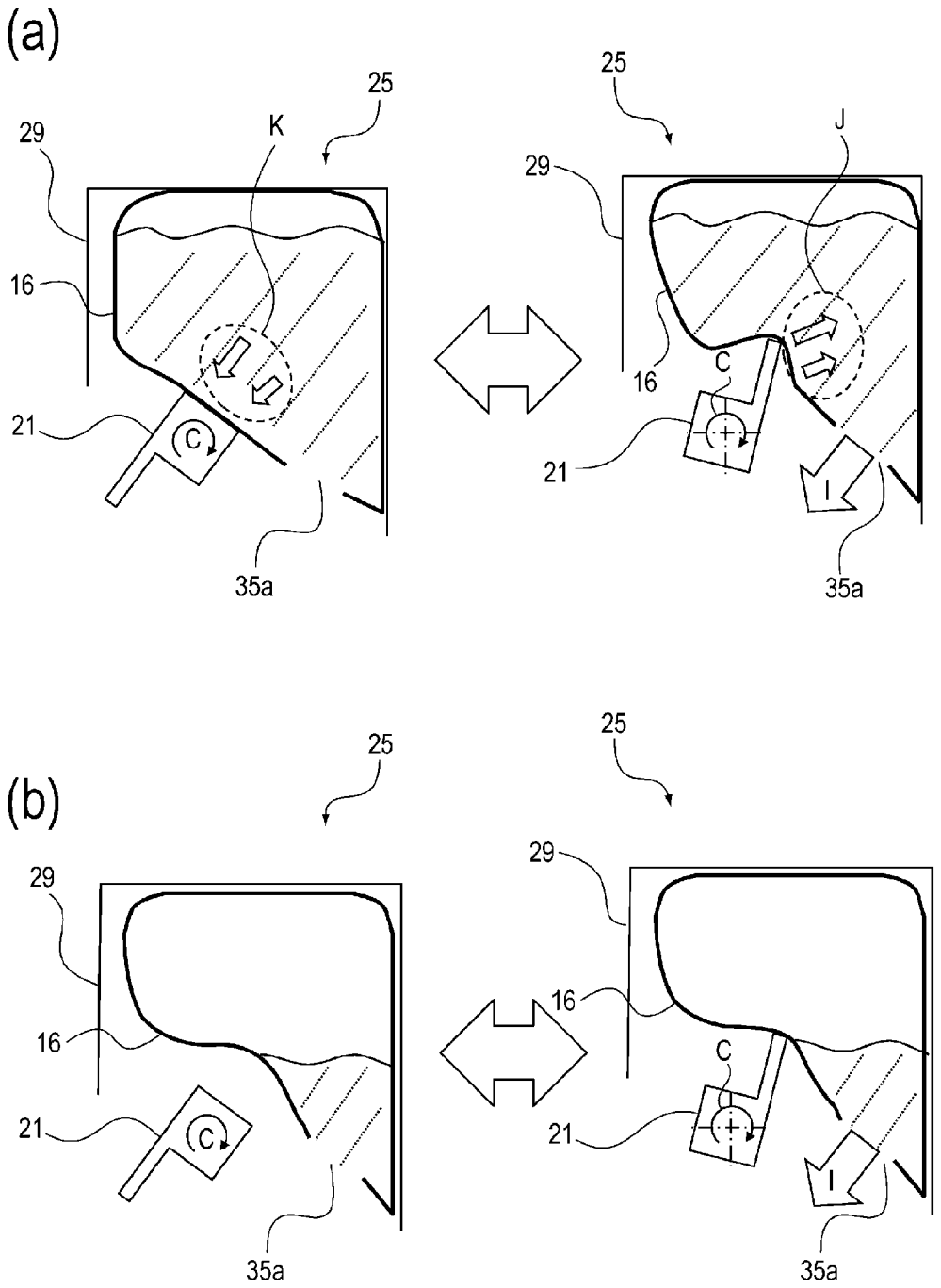

Parts (a) and (b) of FIG. 14 are illustrations of the developer accommodating unit in Embodiment 1 of the present invention.

Figure 15:
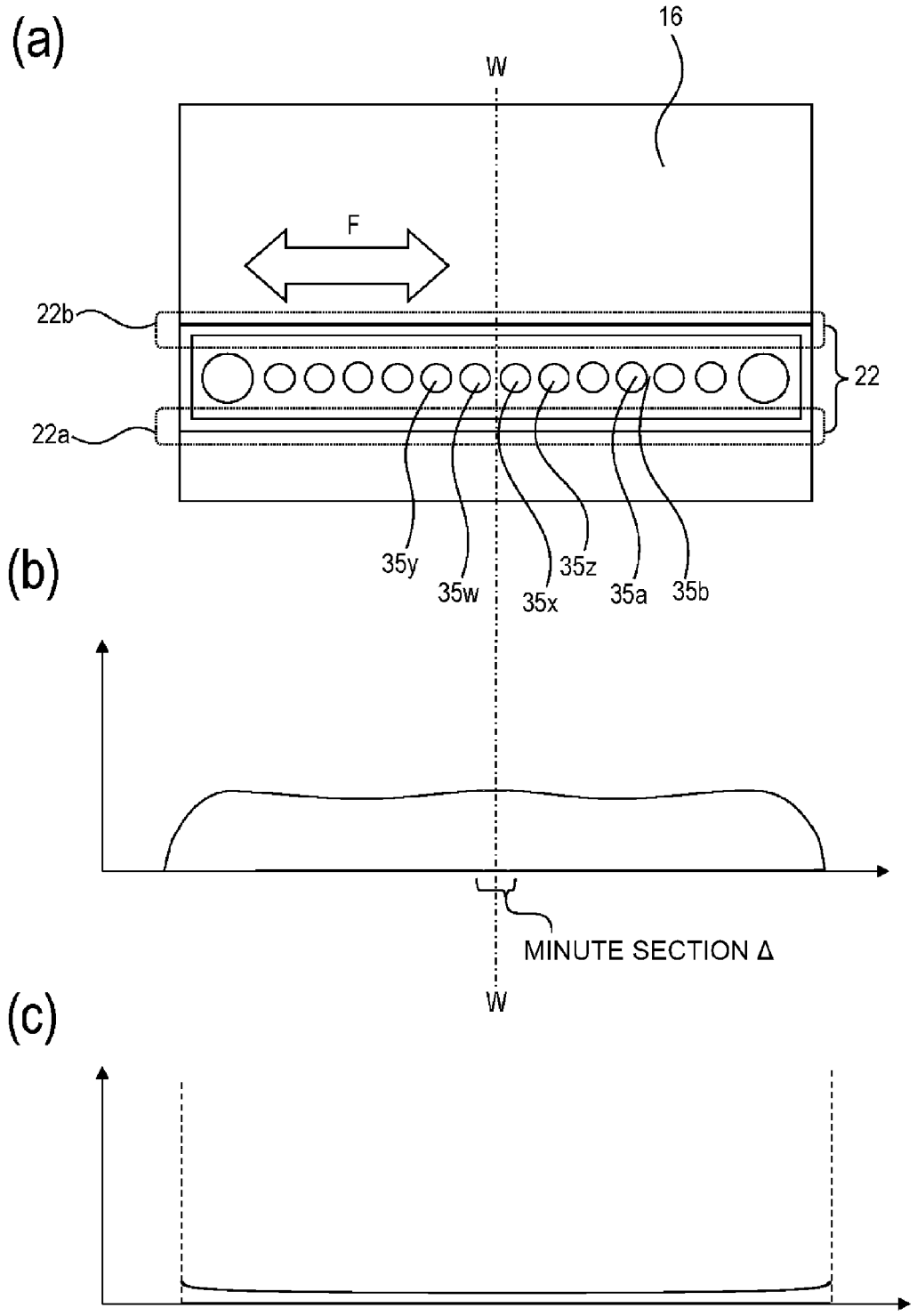

Part (a) of FIG. 15 is a front view showing a structure of a developing bag in Embodiment 1 of the present invention, (b) of FIG. 15 is a longitudinal distribution diagram showing a discharge amount of a developer discharged from the developing bag per unit time in Embodiment 1 of the present invention, and (c) of FIG. 15 is a longitudinal distribution diagram showing an amount of the developer remaining in the developing bag in the case where the developer becomes small in the developing bag in Embodiment 1 of the present invention.

Figure 16:
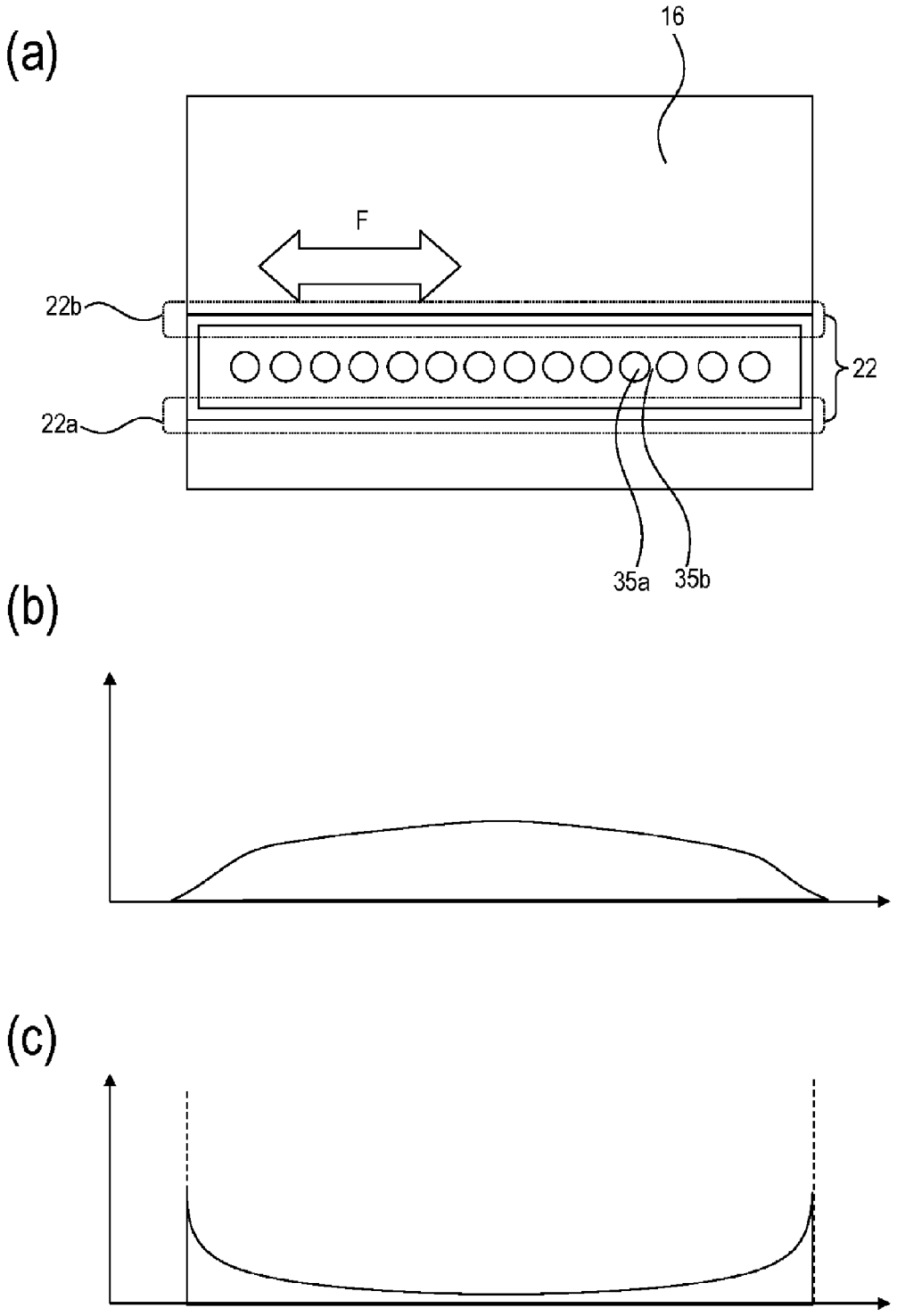

Part (a) of FIG. 16 is a front view showing a structure of a developing bag in Comparison example 1, (b) of FIG. 16 is a longitudinal distribution diagram showing a discharge amount of a developer discharged from the developing bag per unit time in Comparison example 1, and (c) of FIG. 16 is a longitudinal distribution diagram showing an amount of the developer remaining in the developing bag in the case where the developer becomes small in the developing bag in Comparison example 1.

Figure 17:
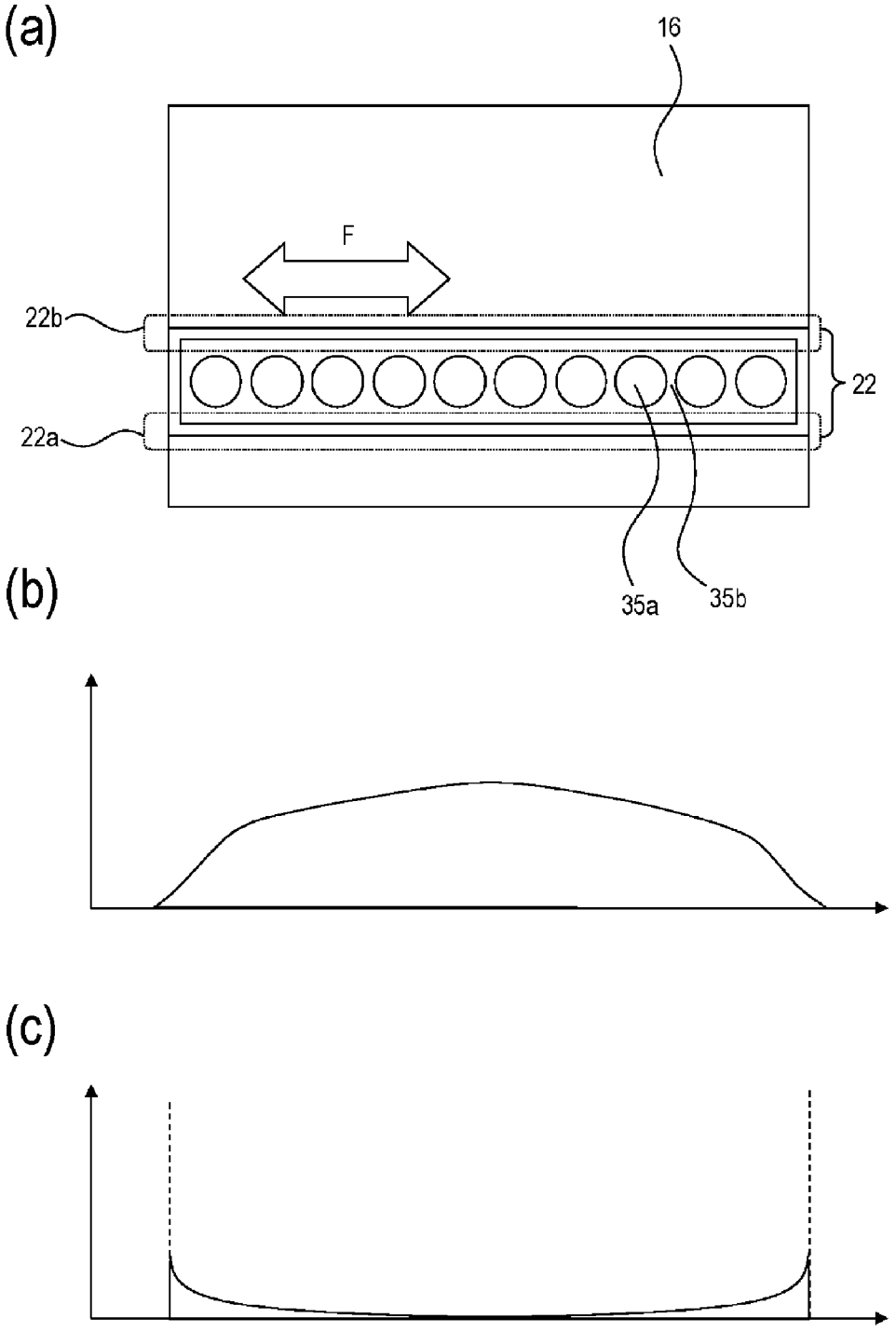

Part (a) of FIG. 17 is a front view showing a structure of a developing bag in Comparison example 2, (b) of FIG. 17 is a longitudinal distribution diagram showing a discharge amount of a developer discharged from the developing bag per unit time in Comparison example 2, and (c) of FIG. 17 is a longitudinal distribution diagram showing an amount of the developer remaining in the developing bag in the case where the developer becomes small in the developing bag in Comparison example 2.

FIGS. 18 to 21 are front views showing structures of developer bags in Embodiments 2 to 5, respectively, of the present invention.

Figure 22:
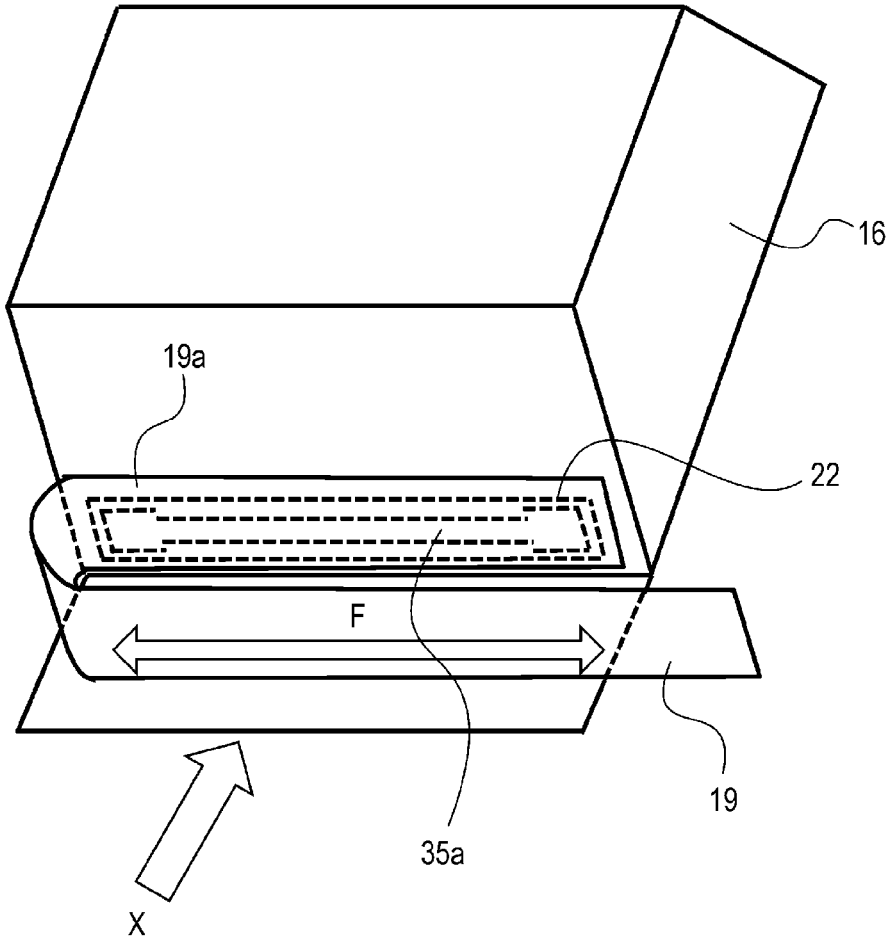

FIG. 22 is a perspective view for illustrating a developer bag and a seal member in Embodiment 6 of the present invention.

FIGS. 23 to 27 are front views showing structures of developer bags in Embodiments 6 to 10, respectively, of the present invention.

Figure 28:
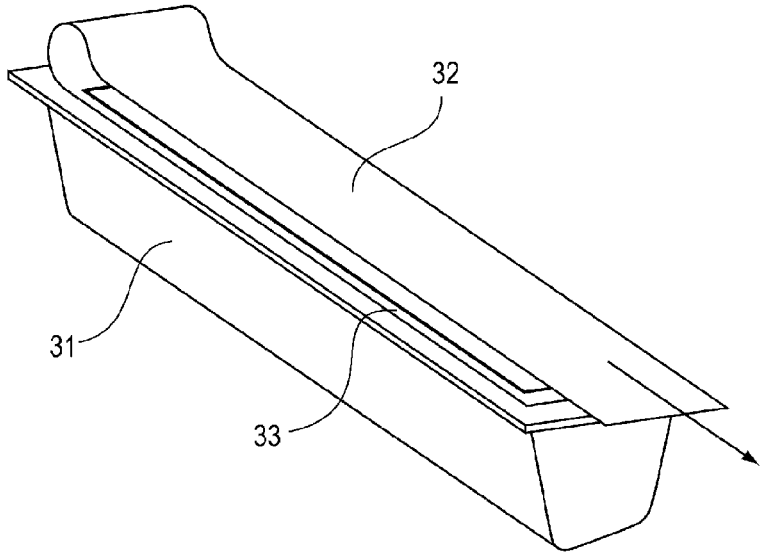

FIG. 28 is an illustration of a conventional developer accommodating container.

Figure 29:
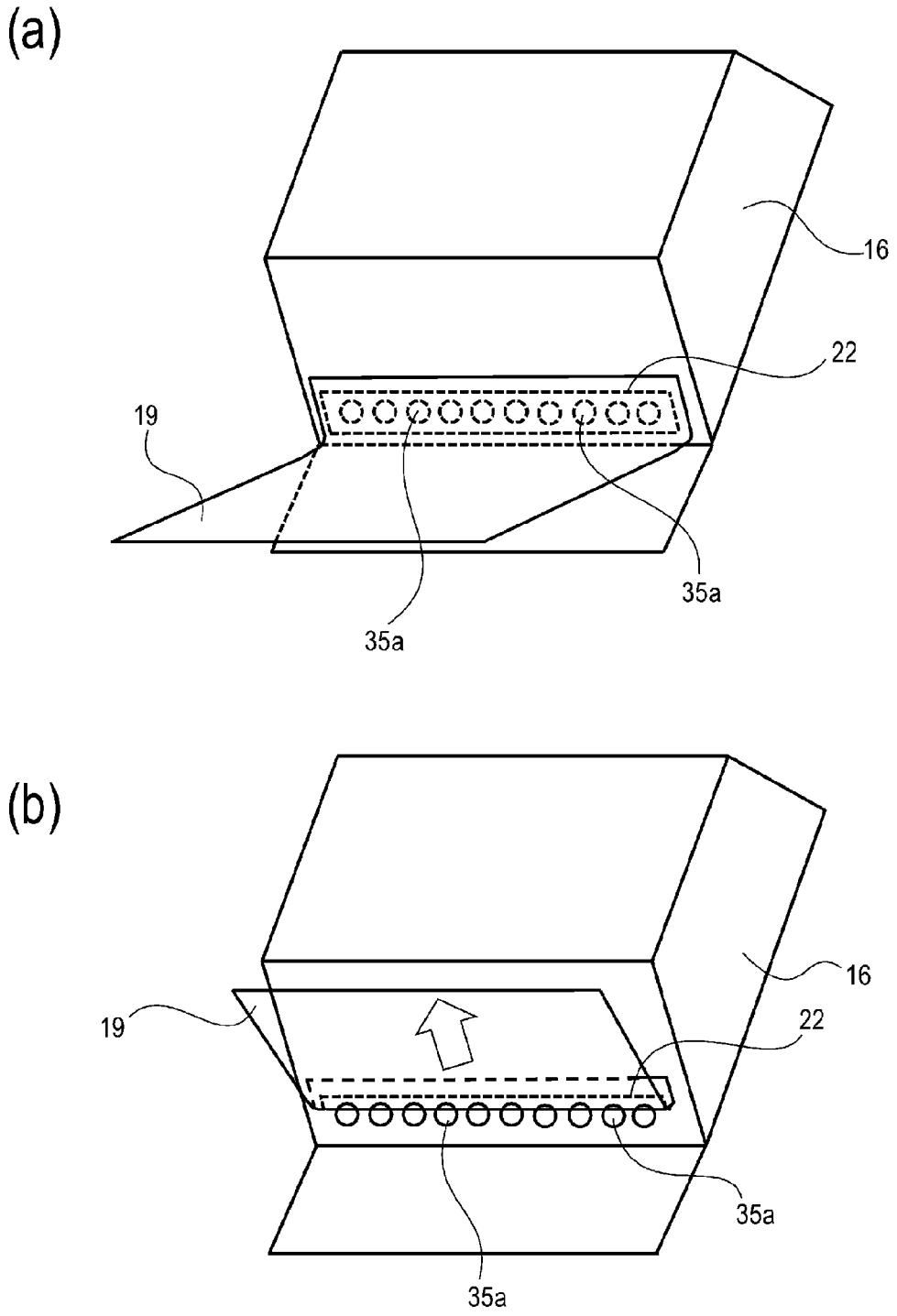

Parts (a) and (b) of FIG. 29 are perspective views for illustrating of a structure of a developing bag in a reference example.

DESCRIPTION OF THE EMBODIMENTS

Hereinbelow, preferred embodiments of the present invention will be exemplarity and specifically described with reference to the drawings. However, dimensions, materials, shapes, relative arrangements and the like of constituent elements described in the following embodiments are appropriately changed depending on constitutions or various conditions of devices (apparatuses) to which the present invention is applied. Therefore, the scope of the present invention is not limited thereto unless otherwise specified.

In the following description, a developer accommodating container refers to at least a flexibility container and a sealing member for sealing an opening, provided to the sealing member, for permitting discharge of a developer. The developer accommodating container which accommodates the developer and which is provided with an unsealing member for removing (unsealing) the sealing member is referred to as a developer accommodating container 30 including the unsealing member. The developer accommodating container which accommodates the developer and which is not provided with the sealing member is referred to as a developer accommodating container 26 accommodating the developer.

Incidentally, for simplification, these developer accommodating containers will be described as the developer accommodating container 30 and the developer accommodating container 26 by using different reference numerals.

A developer accommodating unit includes at least the developer accommodating container and a frame for accommodating the developer accommodating container.

(Embodiment 1)

Figure 1:
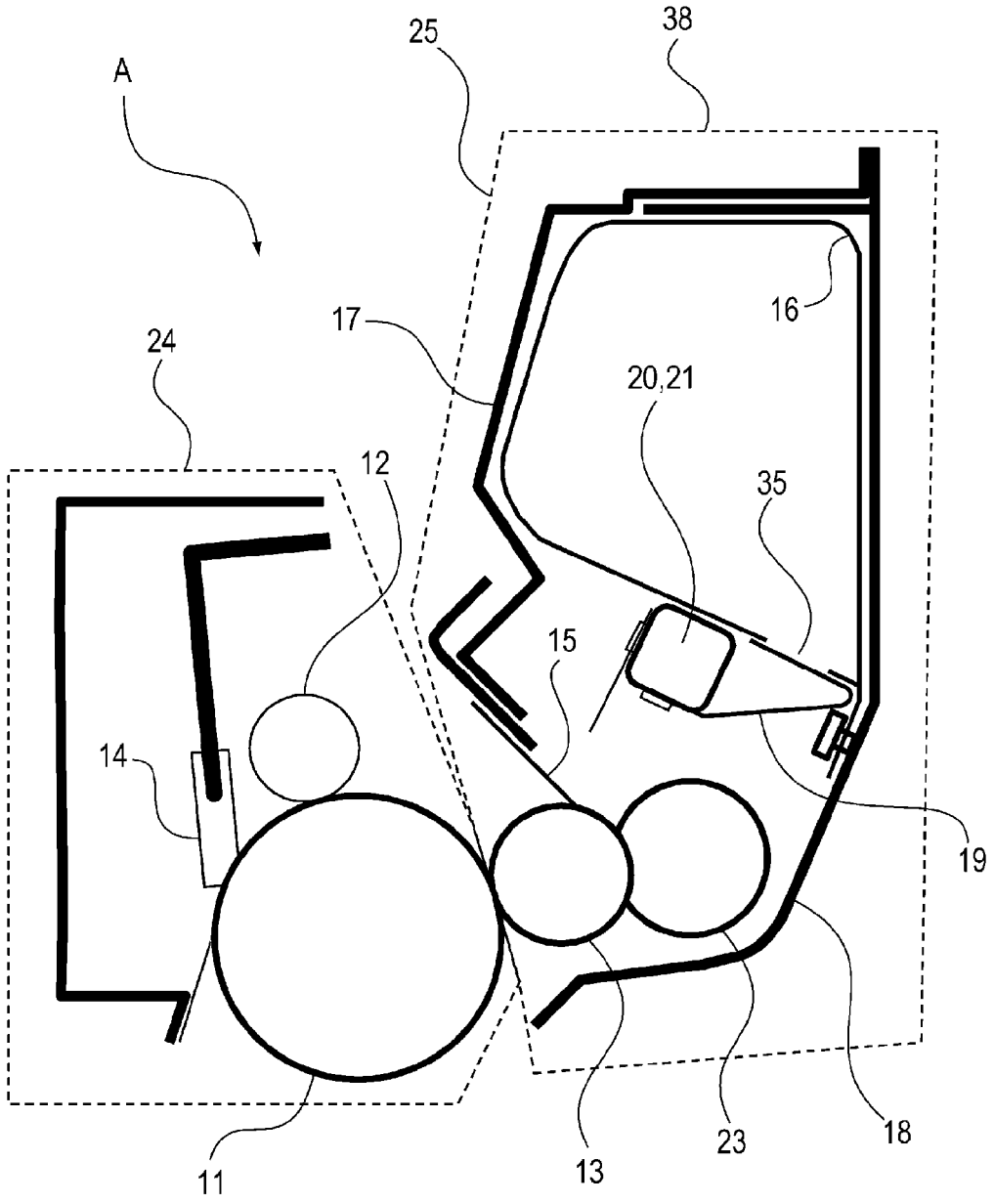
FIG. 1 is a principal sectional view of a process cartridge in Embodiment 1 of the present invention.
Figure 2:
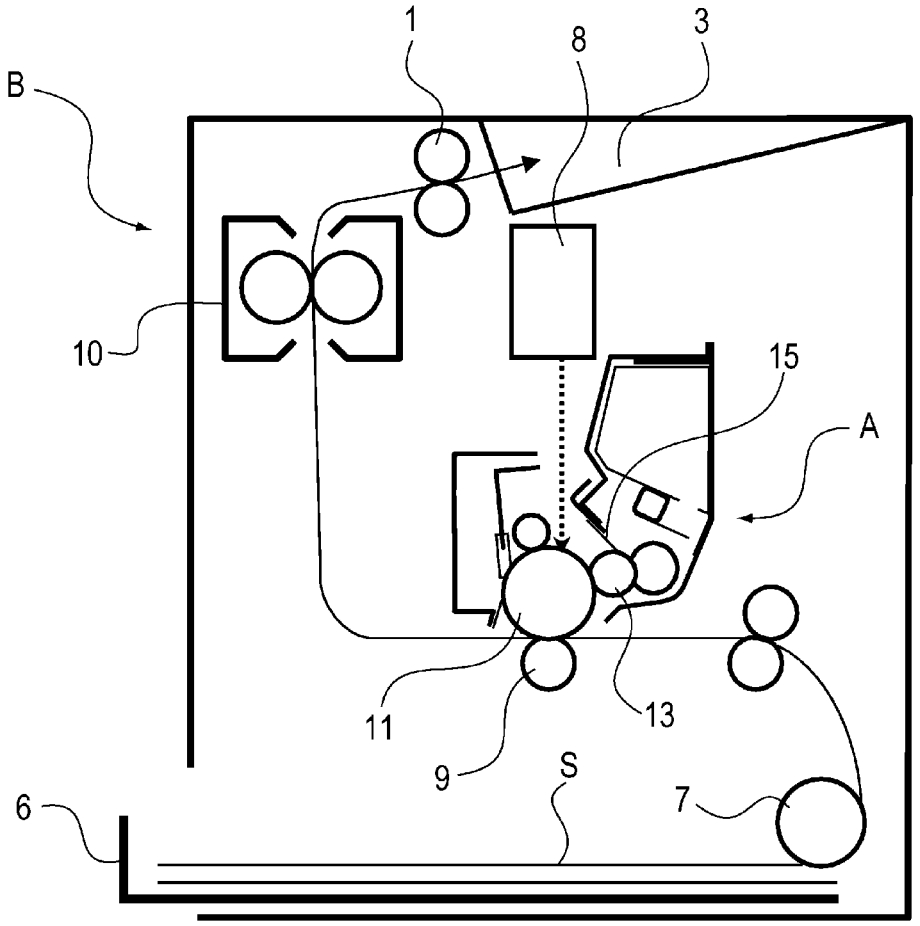
FIG. 2 is a principal sectional view of an image forming apparatus in Embodiment 1 of the present invention.

FIG. 1 is a principal sectional view of a process cartridge including the developer accommodating unit to which the present invention is applicable, and FIG. 2 is a principal sectional view of an image forming apparatus to which the present invention is applicable.

<General Structure of Process Cartridge>

The process cartridge includes an image bearing member and process means acting on the image bearing member. Examples of the process means include a charging means for electrically charging a surface of the image bearing member, a developing device for forming an image on the image bearing member, and a cleaning means for removing a developer (toner, carrier, etc.) remaining on the image bearing member surface.

The process cartridge A in this embodiment includes, as shown in FIG. 1, includes a photosensitive drum 11 as the image bearing member and includes, at a periphery of the photosensitive drum 11, a charging roller 12 as the charging means and a cleaner unit 24 including an elastic cleaning blade 14 as the cleaning means. Further, the process cartridge A includes a developing device 38 including a first frame 17 and a second frame 18. The process cartridge A is prepared by integrally assembling the cleaner unit 24 and the developing device 38, and is constituted so as to be detachably mountable to an image forming apparatus main assembly B as shown in FIG. 2. A developing device 38 includes a developing roller 13 as the developing means, a developing blade 15, a developer supplying roller 23, and a developer accommodating container 26 in which the developer is accommodated. The developing roller 13 and the developing blade are supported by the first frame 17.

<General Structure of Image Forming Apparatus>

The process cartridge A is as shown in FIG. 2, mounted in the image forming apparatus main assembly B and is used for image formation. In the image formation, a sheet S as a recording material (medium) is fed by a feeding roller 7 from a sheet cassette 6 mounted at a lower portion of the apparatus and in synchronism with this sheet feeding, the photosensitive drum 11 is selectively exposed to light by an exposure device 8 to form a latent image. The developer is supplied to the developing roller 13 (developer carrying member) by the developer supplying roller 23 having a sponge shape and is carried in a thin layer on the surface of the developing roller 13. By applying a developing bias to the developing roller 13, the developer is supplied depending on the latent image and thus the latent image is developed into a developer image on the photosensitive drum 11. This developer image is transferred onto the fed sheet S under bias voltage application to a transfer roller 9. The sheet S is conveyed to a fixing device 10, in which the image is fixed on the sheet S and then the sheet S is discharged to a discharging portion 3 at an upper portion of the apparatus.

<Structure of Developer Accommodating Unit>

(Developer Accommodating Container)

Figure 3:
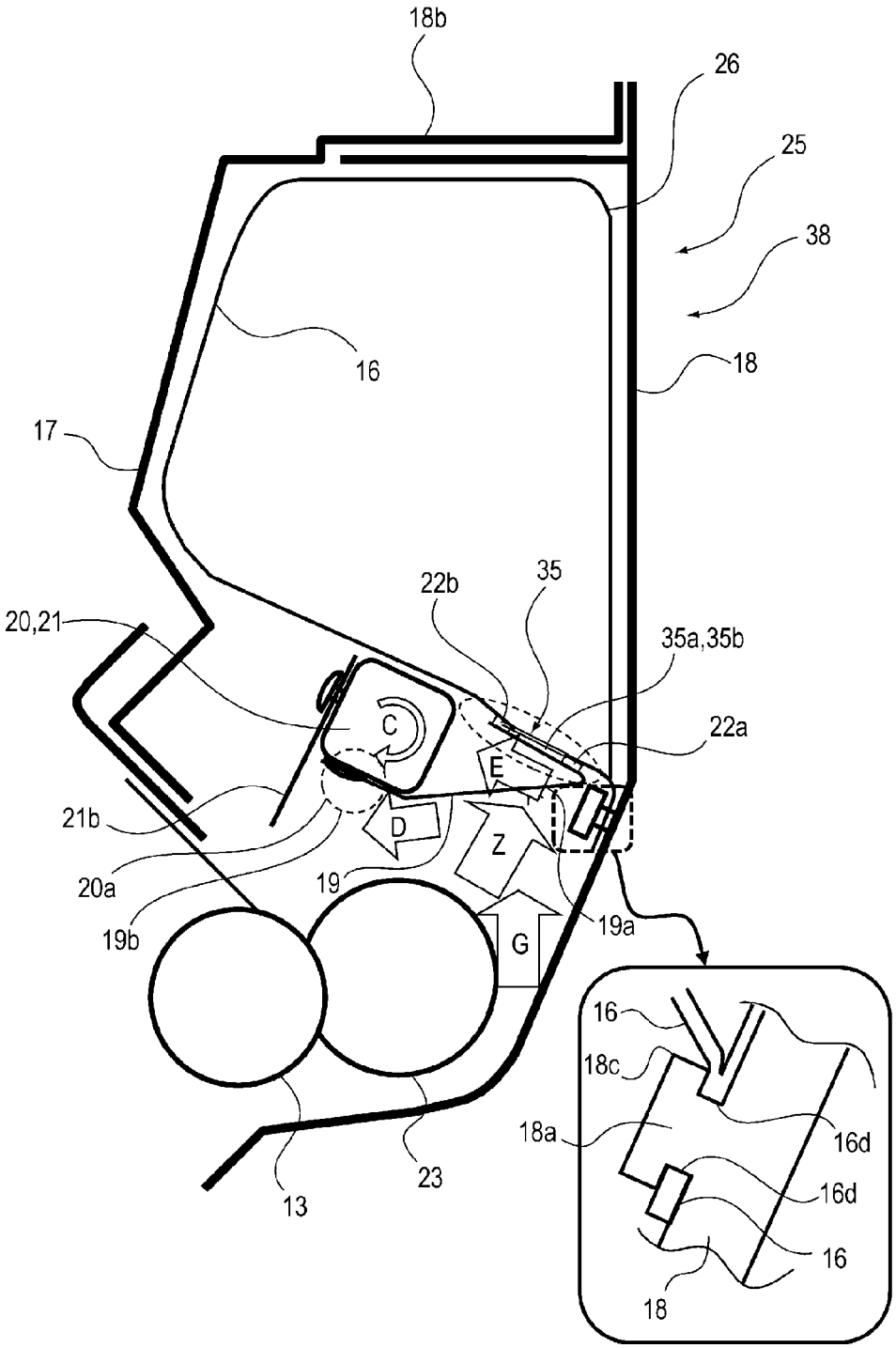
FIG. 3 is a sectional view of a developer accommodating unit before unsealing in Embodiment 1 of the present invention.

Next, a structure of a developer accommodating unit 25 will be described with reference to FIGS. 3 and (a) of FIG. 6. FIG. 3 is a sectional view of the developing device 38 and FIG. 6 is a detailed sectional view in the neighborhood of the discharging portion 35 for permitting discharge of the developer from a developer bag 16 as a flexible container. Incidentally, the sectional views are illustrated along a plane passing through an unsealing member 20, an opening 35*a* and a fixing portion 16*d*, and are illustrated along a plane perpendicular to a rotation shaft of the unsealing member 20.

(Developer Accommodating Unit)

Figure 4:
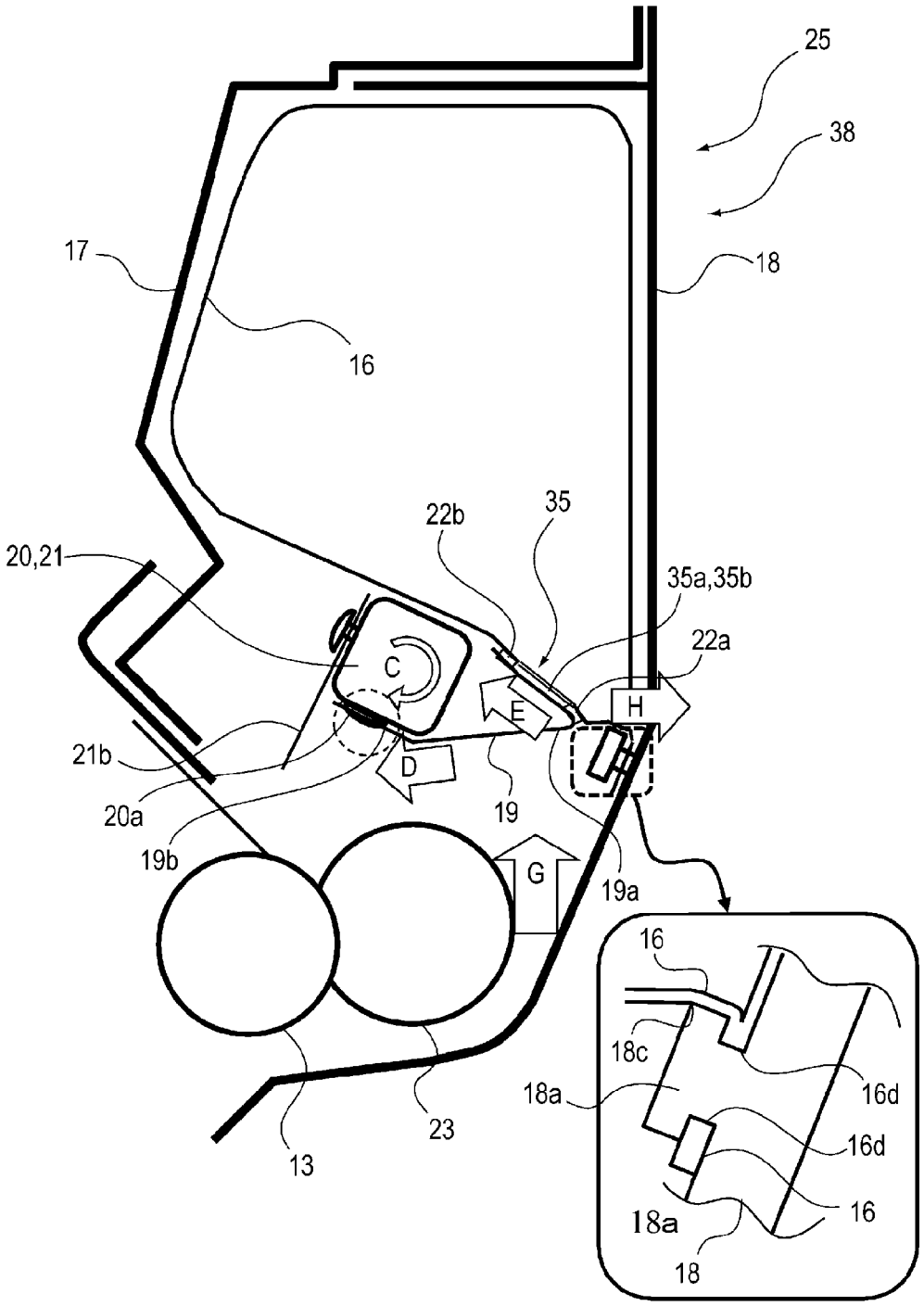
FIG. 4 is a sectional view of the developer accommodating unit immediately before the unsealing in Embodiment 1 of the present invention.

The developer accommodating unit 25 is, as shown in FIG. 4, constituted by the developer accommodating container 30, the developing roller 13, the developing blade 15, the developer supplying roller 23, and the first and second frames 17 and 18 for supporting these members. A combination of the first and second frames is a frame in which the developer accommodating container 30 is accommodated.

In this embodiment, the developer accommodating unit 25 is the same as the developing device 38. This is because the developer accommodating unit 25 includes the developing roller 13, the developing blade 15 and the developer supplying roller 23. However, the developing roller 13, the developing blade 15 and the developer supplying roller 23 may also be supported by a frame separately from the developer accommodating unit 25 and thus may be separated from the developer accommodating unit 25. In this case, the developing device 38 is constituted by the developer accommodating unit 25, the developing roller 13, the developing blade 15 and the developer supplying roller 23 (not shown).

(Developer Accommodating Container)

As shown in FIG. 3, the developing bag 16, in which the developer is accommodated, of the developer accommodating container 26 is provided with a plurality of openings 35*a* sealed with a sealing member 19.

The developer accommodating container 30 including the unsealing member 20 is constituted by the unsealing member 20 and the developer accommodating container 26.

The unsealing member 20 includes an engaging portion 20*b* engaged with the sealing member 19.

On the other hand, the sealing member 19 has a hole as an engaged portion 19*b* engaged with the engaging portion 20*b* of the unsealing member 20 and thus is engageable with the unsealing member 20.

Accordingly, by engaging the engaged portion 19*b* with the engaging portion 20*b* of the developer accommodating container 26, the developer accommodating container 30 including the unsealing member 20 is constituted.

(Structure of Developer Bag)

As shown in FIG. 3, the developer bag 16 accommodating the developer therein and has a bag-like shape which is deformable, and is provided with the plurality of openings 35*a* at the discharging portion 35 for permitting the discharge of the accommodated developer.

Further, the developer bag 16 includes a developer bag fixing portion (fixed portion) 16*d* fixed to the first frame 17 and the second frame 18.

(Structure of Discharging Portion of Developer Bag)

As shown in FIG. 9, the developer bag 16 includes the developer discharging portion 35 consisting of the plurality of openings 35*a* for permitting the discharge of the developer therein and the connecting portion 35*b* defining the plurality of openings 35*a*. Further, the discharging portion 35 is continuously surrounded by a bonding portion 22 to be unsealably bonded, so that the developer accommodated in the developer bag 16 is sealed with the sealing member 19.

(Structure of Bonding Portion of Developer Bag)

The bonding portion 22 has a rectangular shape consisting of two lines extending in a longitudinal (long) direction (arrow F direction) and two lines extending in a widthwise (short) direction (arrow E direction) perpendicular to the longitudinal direction so as to surround the discharging portion 35 and therefore the bonding portion 22 enables the sealing of the discharging portion 35.

Here, of the two lines of the welded bonding portion 22 extending in the longitudinal direction (arrow F direction), a bonding portion which is first unsealed is referred to as a first bonding portion 22*a* and a bonding portion which is unsealed later is referred to as a second bonding portion 22*b*. In this embodiment, in the case where the bonding portion 22 is viewed along the surface of the sealing member 19, a bonding portion closer to a fold-back portion 19*d* (or engaged portion 19*b*) described later is a first bonding portion 22*a*. Further, a bonding portion opposing the first bonding portion 22*a* via the opening 35*a* is a second bonding portion 22*b*. Further, a bonding portion with respect to the widthwise direction perpendicular to the longitudinal direction is a widthwise bonding portion 22*c*.

In this embodiment, an unsealing direction is the arrow E direction. The unsealing direction is defined as follows. In the case where the unsealing is effected by moving the sealing member 19, of the first bonding portion 22*a* and the second bonding portion 22*b* opposing to each other via the opening 35*a*, the first bonding portion 22*a* is first unsealed (peeled). Thus, a direction directed from the first bonding portion 22*a* to be first unsealed toward the second bonding portion 22*b* is the unsealing direction (arrow E direction).

When the sealing member 19 is unsealed (peeled) from the developer bag 16 in the arrow E direction, in some cases, the peeling microscopically progresses also in the arrow F direction due to the deformation of the developer bag 16 by an unsealing force also in the first bonding portion 22*a* and the second bonding portion 22*b*. However, the unsealing direction in this embodiment does not refer to such a microscopic unsealing direction.

(Disposition of Openings of Developer Bag)

Next, disposition of the openings 35*a* will be described with reference to FIGS. 9 and 10. The movement direction of the sealing member 19 for sealing the openings 35*a* and for exposing the openings 35*a* by being moved is an arrow D direction. By the movement of the sealing member 19, the exposure of the openings 35*a* progresses in the unsealing direction (arrow E direction). In the following, the movement direction of the sealing member 19 is the arrow D direction.

The plurality of openings 35*a* and the plurality of connecting portions 35*b* are alternately disposed along the direction (arrow F direction) perpendicular to the unsealing direction (arrow E direction). An opening area of each of the plurality of openings 35*a* is larger at end portions than at a central portion with respect to the arrow F direction as the longitudinal direction. That is, a diameter of each of round holes of the openings 35*a* is larger at the longitudinal end portions than at the longitudinal central portion. A detailed description as to an effect by such a constitution of the openings 35*a* will be made in (Summary of discharge) appearing later. Incidentally, the central portion with respect to the longitudinal direction (arrow F direction) refers to a region including an opening closest to a center line (center line w-w indicated in FIG. 15). Further, the sealing member 19 is configured to be wound up by rotating the unsealing member 20 but the arrow F direction is the same direction as an axis (axial line) of the rotation shaft of the unsealing member 20.

The plurality of openings 35*a* are shifted and disposed along the longitudinal direction (arrow F direction) and therefore the discharging portion 35 is long in the arrow F direction and is short in the arrow E direction. That is, with respect to the arrow F direction, a distance from an end to another end of the plurality of openings 35*a* is longer than that with respect to the arrow E direction.

(Shape and Direction of Openings of Developer Bag)

Each of the plurality of openings 35*a* in Embodiment 1 has a circular (round) shape.

Incidentally, the shape of each opening 35*a* is not limited to the circular shape but may also be, in addition to the circular shape, a polygonal shape such as a rectangular shape, an elongated circular shape, and the like shape.

Further, the direction of the openings 35*a* may preferably be such that the developer accommodated in the developer bag 16 is easily discharged in an attitude during image formation. For that reason, in the attitude during image formation, the openings 35*a* are disposed so as to be open downward with respect to the gravitational direction. The state in which the openings 35*a* open downward with respect to the gravitational direction refers to that the direction of the openings 35*a* has a downward component with respect to the gravitational direction.

(Fixing Between Developer Bag and Frame)

As shown in FIG. 3, the developer bag 16 is fixed inside the first frame 17 and the second frame 18 by the fixing portion 16*d*.

(Fixing Portion)

First, as the fixing portion, as shown in FIG. 10, the fixing portion 16*d* of the developer bag 16 where a force is received when the sealing member 19 is unsealed (removed) from the developer bag 16 as described later is provided. The first fixing portion 16*d* is provided at a plurality of positions in parallel to the direction (arrow F direction) along which the plurality of openings 35*a* are arranged. Different from the arrangement at the plurality of positions, the first fixing portion 16*d* may also be a single fixing portion elongated in parallel to the arrow F direction (not shown).

The fixing portion 16*d* is positioned in the neighborhood of the openings 35*a*.

The fixing portion 16*d* of the developer bag 16 is fixed to a first fixing portion 18*a* of the frame.

The fixing portion 16*d* is fixing position necessary for the time of unsealing the developer bag 16, and its action and arrangement will be described later in the description of the unsealing.

<Structure of Sealing Member>

As shown in FIG. 3, the sealing member 19 covers the distance opening 35 of the developer bag 15 before use of the cartridge A to confine the developer in the developer bag 16. The sealing member 19 is moved, so that the openings 35*a* are exposed. The sealing member 19 is constituted by a sheet-like sealing member including a sealing portion 19*a* for covering (sealing) the discharging portion 35 of the developer bag 16, the engaged portion 19*b* to be fixed (engaged) with the unsealing member 20 described later, and a sealing member connecting portion 19*c* which connects the sealing portion 19*a* and the engaged portion 19*b*. The sheet is formed of a laminate material having a sealant layer which exhibits an easy-unsealing property described later, and a base material therefor is polyethylene telephthalate (PET), polyethylene, polypropylene or the like. A thickness of the sheet-like sealing member may appropriately be set in a range of 0.03-0.15 mm.

(Sealing Portion of Sealing Member)

A sealing portion 19*a* refers to a region where the sealing member 19 seals the plurality of openings 35*a* and connecting portions 35*b* of the developer bag 16. By the sealing portion 19*a*, the developer is prevented from being leaked from the inside of the developer bag 16 until before use of the process cartridge A.

(Engaging Portion of Sealing Member)

The sealing member 19 has a free end portion in one end side thereof with respect to the unsealing direction (arrow E direction) and at the free end portion, the engaged portion 19*b* to be engaged with the unsealing member 20 for moving the sealing member 19 is provided. With the engaged portion 19*b*, the unsealing member 20 for moving the sealing member 19 so as to expose the openings 35*a* is engaged. The unsealing member 20 may also be configured to automatically perform the unsealing by receiving a driving force from the image forming apparatus main assembly B. Or, the unsealing member 20 may also be configured to perform the unsealing by being held and moved by the user. In this embodiment, the unsealing member 20 is a rotation shaft provided in the frame, and the sealing member 19 engaged with the unsealing member 20 is pulled, so that the developer accommodating container 26 accommodating the developer is unsealed.

(Sealing Member Connecting Portion of Sealing Member)

A portion for connecting the bonding portion 22 and the sealing member engaging portion (engaged portion) 19*b* is the sealing member connecting portion 19*c*. The sealing member connecting portion 19*c* is a portion for transmitting a force so as to pull off the bonding portion 22 by receiving the force from the unsealing member 20.

(Folding-back of Sealing Member Connecting Portion)

Referring to FIG. 11, a surface formed between the first bonding portion 22*a* and the second bonding portion 22*b* at the movement of the unsealing is taken as N1. A surface which is perpendicular to the surface N1 and which passes through the first bonding portion 22*a* is taken as N2.

The unsealing member 20 is disposed in the second bonding portion 22*b* side more than the surface N2 passing through the first bonding portion 22*a*. In other words, the sealing member 19, when it is seen along the surface of the sheet-like sealing member 19, includes a fold-back portion 19*d* where the sealing member 19 is folded back at the portion (connecting portion 19*c*) between the connecting portion 22 and the engaged portion 19*b* engaged with the unsealing member 20.

The fold-back portion 19*d* may be provided with or not provided with a fold (crease). A folding angle Q of the sealing member 19 may preferably be 90 degrees or less. The folding angle Q is a narrow angle Q between a surface of the bonding portion 22 of the developer bag 16 and a surface along the arrow D direction in which the sealing member 19 is pulled.

(Portion Having Easy-unsealing Property of Sealing Member)

A method of providing a peeling force of the bonding portion 22 with a desired value will be described. In this embodiment, in order to provide the peeling force with the desired value (a minimum force within a range in which the toner sealing property can be maintained), two methods are principally employed.

In a first method, a laminate material having a sealant layer for enabling easy unsealing of the sealing member is applied. Further, the first method is a method in which the easy unsealing is enabled at the bonding portion by using, as the material for the developer bag 16, a sheet material (of, e.g., polyethylene or polypropylene) which is weldable with the sealant layer and which has flexibility. By changing a combination of formulation of the sealant layer with the material to be bonded, the peeling force can be adjusted correspondingly to a desired condition. In this embodiment, a material having a peeling strength of about 3N/15 mm measured by testing methods for heat sealed flexible packages (JIS-Z0238) is used.

A second method is a method in which as shown in FIGS. 3, 4 and 11, the discharging portion 35 of the developer bag 16 is placed in a state in which the sealing member 19 is folded back with respect to an unsealing direction (arrow E direction in the figures). For example, in the state of FIG. 3, the unsealing member 20 is rotated (in an arrow C direction), so that the sealing member 19 is pulled in a pulling direction (arrow E direction) by the unsealing member 20. As a result, the developer bag 16 and the sealing member 19 provide an inclined peeling positional relationship, as shown in FIG. 11, in which the narrow angle Q between the surface of the bonding portion 22 of the developer bag 16 and the surface along the pulling direction (arrow D direction) of the sealing member 19 is 90 degrees or less. It has been conventionally known that the peeling force necessary to separate the both surfaces can be reduced by establishing the inclined peeling positional relationship. Therefore, as described above, the discharging portion 35 is placed in the state in which the sealing member 19 is folded back with respect to the unsealing direction (arrow E direction), so that the sealing member 19 of the bonding portion 22 and the developer bag 16 are placed in the inclined peeling positional relationship and thus the peeling force can be adjusted so as to be reduced.

<Structure of Unsealing Member>

The unsealing member 20 is used for the purpose of peeling the sealing member 19 from the developer bag 16 by applying a force to the sealing member 19 to move the sealing member 19. The unsealing member 20 includes a supporting portion (not shown) which has a shaft shape and which is rotatably supported by the second frame 18 at its ends, and includes an engaging portion 20*b* to which the engaged portion 19*b* of the sealing member 19. In this embodiment, the unseal member 20 has a rectangular shaft shape, and the engaged portion 19*b* of the sealing member 19 is engaged with the engaging portion 20*b* at one of four surfaces of the rectangular shaft.

<Summary of Unsealing of Developer Bag>

The unsealing of the developer bag 16 will be described with reference to FIGS. 3 to 8.

For unsealing the developer bag 16, the developing device 28 includes a power application point portion 20*a* where the unsealing member 20 applies the force for pulling the sealing member 19, and includes the fixing portion 18*a* of the frame for fixing the developer bag 16 to be pulled.

The power application point portion 20*a* is a portion, closest to the bonding portion 22, of a portion where the sealing member 19 and the unsealing member 20 contact at the moment of the unsealing. In (b) of FIG. 6, a corner portion 20*c* of the unsealing member constitutes the power application point portion 20*a*. The fixing portion 18*a* of the second frame 18 includes a fixing portion 18*c* for suppressing movement of the developer bag 16 caused by the force during the unsealing. In this embodiment, the first fixing portion 18*a* of the frame and the bonding portion 16*d* of the developer bag are bonded to each other by the ultrasonic clamping, and as shown in (b) and (c) of FIG. 6 and (a) of FIG. 7, a portion, closer to the bonding portion 22, of the fixing portion 18*a* bonded by the ultrasonic clamping constitutes the fixing portion 18*c*.

As shown in FIG. 3, the unsealing member 20 is rotated in the arrow C direction by transmission of the driving force thereto from the main assembly by an unshown driving means.

Figure 5:
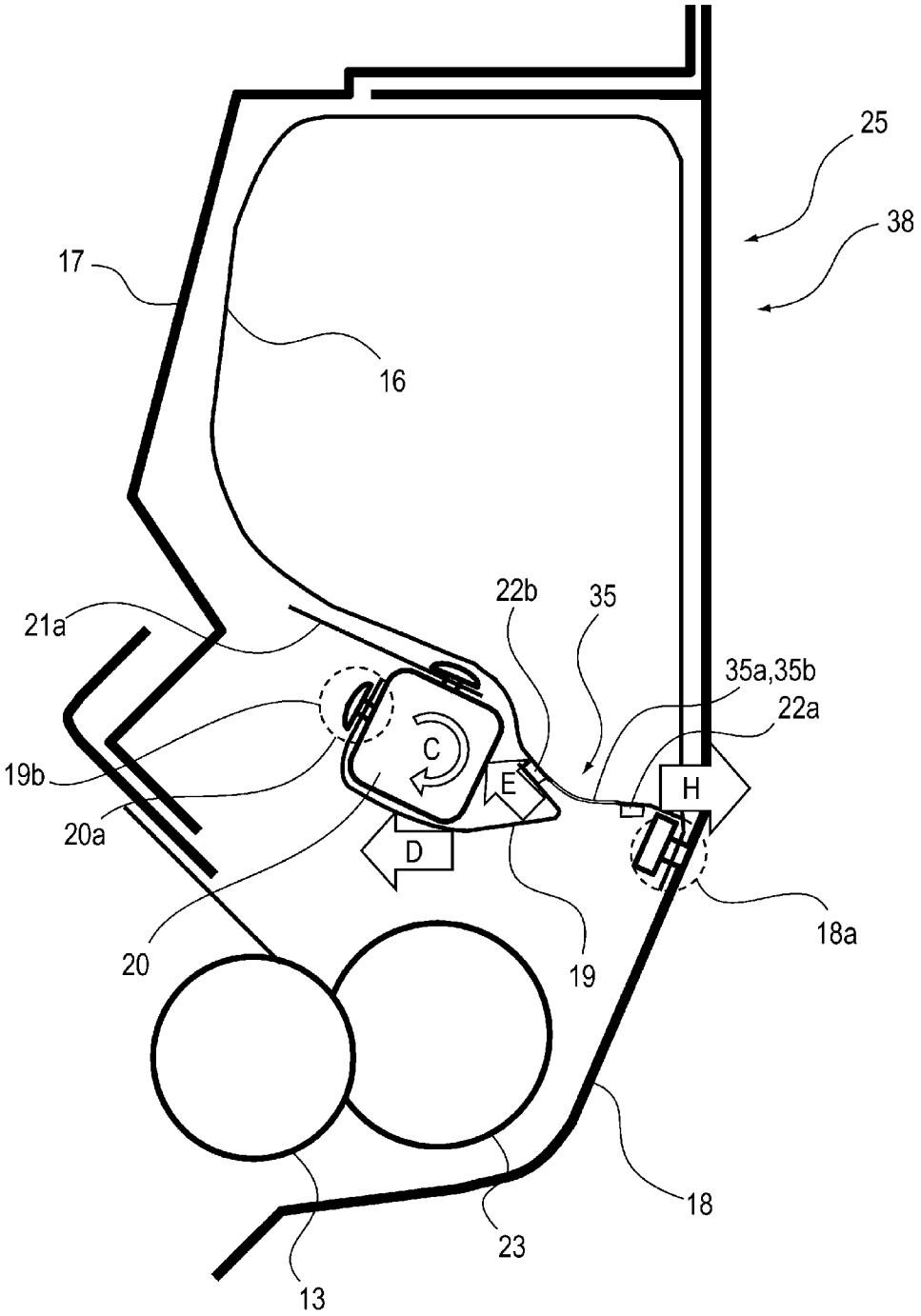
FIG. 5 is a sectional view of the developer accommodating unit in which a discharging portion is unsealed in midstream in Embodiment 1 of the present invention.

A state immediately before the sealing member 19 is pulled by further rotation of the unsealing member 20 to start the unsealing is shown in FIG. 5 and (c) of FIG. 6. With the rotation, the sealing member 19 fixed to the unsealing member 20 by the engaged portion 19*b* is pulled in the arrow D direction by the corner portion 20*c* (power application point portion 20*a*) of the rectangular unsealing member 20.

When the sealing member 19 is pulled, the developer bag 16 is pulled via the bonding portion 22. Then, a force is applied to the first fixing portion 16*d* of the developer bag 16, so that the developer bag 16 is pulled from the fixing portion 18*c* toward the power application point portion 20*b* by the fixing portion 18*c*. Then, in a cross section perpendicular to the rotation shaft of the unsealing member 20, the first bonding portion 22*a* is moved to approach a line connecting the power application point portion 20*a* and the fixing portion 18*c*. At this time, with respect to the arrow D direction, from a side close to the rotation shaft of the unsealing member 20, the portions are disposed in the order of the openings 35*a*, the first bonding portion 22*a*, the fold-back portion 19*d* and the fixing portion 18*c* ((b) of FIG. 6). Further, the unsealing member 20 is folded back between the first bonding portion 22*a* and the engaged portion 19*b* and therefore the force is applied to the portion of the first bonding portion 22*a* so as to be inclination-peeled in the arrow D direction. Then, the peeling of the first bonding portion 22*a* is effected to start the unsealing of the discharging portion 35.

Together with the corner portion 20*c*, also the power application point portion 20*a* is moved in the arrow C direction, and when the sealing member contacts a corner portion 20*d*, the power application point portion 20*a* is moved from the corner portion 20*c* to the corner portion 20*d*. Part (b) of FIG. 6 shows a state in which the power application point portion 20*a* is the corner portion 20*c* of the unsealing member 20 and (c) of FIG. 6 shows a state in which the unsealing member 20 in further rotated and thus the power application point portion 20*a* is moved to the corner portion 20*d*.

As shown in FIG. 5 and (c) of FIG. 6, when the unsealing is advanced with further rotation of the unsealing member 20, also the fold-back portion 19*d* is moved in the arrow E direction. Then, the unsealing is further advanced, so that the openings 35*a* are exposed. A state in which the peeling of the second bonding portion 22*b* is to be started after the openings 35*a* are exposed is shown in (a) of FIG. 7. Also at this time, similarly as in the case of the peeling of the first bonding portion 22*a*, the sealing member 19 is pulled toward the power application point portion 20*a*, and the developer bag 16 stands firm toward a direction of the fixing portion 18*c* (an arrow H direction). Then, in a cross section perpendicular to the rotation shaft of the unsealing member 20, the second bonding portion 20*b* is moved to approach a line connecting the power application point portion 20*a* and the fixing portion 18*c*. Then, the force is applied to the portion of the bonding portion 22*b* in the arrow D direction, so that the second bonding portion 22*b* is separated. Thus, the second bonding portion 22*b* is peeled to complete the unsealing ((b) of FIG. 7 and FIG. 8). Then, the developer inside the developer bag 16 is discharged in an arrow I direction through the openings 35*a* of the discharging portion 35.

Thus, the sealing member 19 is wound up around the unsealing member 20 by the rotation of the unsealing member 20, so that the bonding portion 22 is unsealed.

With respect to the discharge of the developer during the unsealing, as described above, the bonding portion 22 is moved along the line connecting the power application point portion 20*a* and the fixing portion 18*c* (in the order of (a) of FIG. 6, (b) of FIG. 6, (c) of FIG. 6 and (a) of FIG. 7). By this motion, the developer at the periphery of the openings 35*a* is moved, so that agglomeration of the developer can be broken.

(Positional Relation of Fixing Portion Associated with Unsealing)

As shown in FIG. 3, in order to peel off the first bonding portion 22*b* with reliability, the following positional relation is required between the first bonding portion 22*b* and the fixing portion 18*c*. During the unsealing, with respect to the fixing portion 18*c*, the unsealing member 20 pulls the sealing member 19 in the arrow D direction. At this time, with respect to the movement direction D of the sealing member 19 by the unsealing member 20, the fixing portion 18*c* is provided upstream of the openings 35*a*. For that reason, a force is applied to the fixing portion 18*c* in the arrow H direction. Therefore, when the unsealing force is applied, the sealing member 19 is pulled in the arrow H direction and the arrow develop direction between the fixing portion 18*c* and the unsealing member 20 to apply a force to the first bonding portion 20*a*, thus advancing the unsealing. Thus, when the fixing portion 18*c* is not provided upstream with respect to the movement direction (arrow D direction) of the sealing member 19, the entire developer bag 16 is pulled in the direction in which the sealing member 19 is pulled, so that the force cannot be applied to the first bonding portion 22*a* and thus the first bonding portion 22*a* cannot be unsealed.

In this way, the fixing portion 18*c* is provided upstream with respect to the movement direction D of the sealing member 19, so that reliable unsealing becomes possible.

(Positional Relation of Second Bonding Portion)

With reference to FIG. 11 showing a state immediately before the first bonding portion 22*a* is unsealed, an arrangement in which the second bonding portion 22*b* can be more satisfactorily unsealed without being wound up around the unsealing member 20 will be described. First, an end portion of the first bonding portion 22*a* remote from the openings 35*a* is taken as a second point 22*e*. An end portion of the second bonding portion 22*b* remote from the openings 35*a* is taken as a third point 22*f*. A distance from the second point 22*e* to the third point 22*f* is taken as L1. A distance from the second point 22*e* to the power application point portion 20*a* is taken as L2. In this case, the distances L1 and L2 are required to satisfy the relationship of L1<L2.

This is because in the case where L1 is larger than L2, the second bonding portion 22*b* reaches the power application point portion 22*a* before the peeling of the second bonding portion 22*b* is ended, and thus the second bonding portion 22*b* is wound about the unsealing member 20. Therefore, the force cannot be applied so as to peel off the sealing member 19 from the second bonding portion 22*b*. For that reason, it becomes difficult to unseal the sealing member 19 from the developer bag 16.

As described above, the relationship between the distance L1 and L2 is made to satisfy: L1<L2, the sealing member 19 is satisfactorily unsealable without being wound about the unsealing member 20.

(Function of Connecting Portions Defining Openings)

A summary of the connecting portions 35*b*, defining the openings 35*a*, which perform a large function in the unsealing operation of the developer bag 16 will be described.

FIG. 10 is a schematic view of the discharging portion 35 when the peeling at the first bonding portion 22*a* to be first unsealed is ended to expose the openings 35*a*, and shows a state in which the peeling at the second bonding portion 22*b* is not ended. As described above, the discharging portion 35 includes the plurality of openings 35*a* shifted and disposed along the direction F perpendicular to the unsealing direction E in which the exposure of the openings 35*a* is advanced. For that reason, also the portion connecting portions 35*b* defining the plurality of openings 35*a* are disposed along the longitudinal direction F. As a result, the portion connecting portions 35*b* connect the first bonding portion 22*a* and the second bonding portion 22*b* with respect to the unsealing direction (arrow E direction) of the openings 35*a*. For that reason, at the time of the state of (a) of FIG. 7 in which the unsealing of the first bonding portion 22*a* is ended, the force for unsealing the second bonding portion 22*b* can be received by the fixing portion 16*d* via the connecting portions 35*b*, so that the force for peeling off the sealing member 19 from the developer bag 16 can be transferred. That is, the forces are applied to the second bonding portion 22*b* in the arrow D direction and the arrow E direction, so that also at the second bonding portion 22*b*, the sealing member 19 is peelable.

Thus, by the presence of the connecting portions 35*b* for connecting the first and second bonding portions 22*a* and 22*b* at the discharging portion 35 of the developer accommodating container 26 accommodating the developer and the developer accommodating container 30 including the unsealing member 20, the unsealing force of the unseal member 20 can be transmitted until the second bonding portion 22*b* is unsealed, so that the discharging portion 35 can be unsealed with reliability.

A relationship between the openings 35*a* and the engaged portion 19*b* of the sealing member 19 will be described (FIGS. 3 and 9). The engaged portion 19*b* is provided in an end side of the sealing member 19 with respect to the direction substantially perpendicular to the direction in which the plurality of openings are arranged.

A relationship between the openings 35*a* and the unsealing member 20 will be described (FIGS. 3 and 9). The unsealing member 20 is provided in an end side of the sealing member 19 with respect to the direction substantially perpendicular to the direction in which the plurality of openings are arranged.

<Summary of Urging Member and Developer Discharge)

(Urging Member)

As shown in FIG. 12, the urging member 21 includes a shaft portion 21*a* and an urging sheet 21*b* fixed to the shaft portion 21*a* and is provided rotatably inside the first frame 17 and the second frame 18.

The shaft portion 21*a* performs a function by the same part as the unsealing member 20 (21*a*=20). Therefore, as described above, the driving force is transmitted to the urging member 21 by the unshown driving means of the image forming apparatus main assembly B, so that the urging member 21 (=20) is rotated in the arrow C direction.

The urging sheet 21*b* is fixed on a surface of a rectangular shaft portion 21*a* in cross section and is rotated together with the shaft portion 21*a*. The urging sheet 21*b* is a flexible sheet formed of a material such as PET, PPS (polyphenylene sulfide) or polycarbonate, in a thickness of about 0.05-0.1 mm, and an end thereof projects to the outside of a circumscribed circle of the shaft portion 21*a*. In this embodiment, on different surfaces of the shaft portion 21*a*, the sealing member 19 and the urging sheet 21*a* are fixed but may also be fixed on the same surface of the shaft portion 21*a*.

As shown in FIGS. 12 and 13, the urging sheet 21*b* also performs the function of stirring the developer and feeding the developer toward the developing roller 13 and the developer supplying roller 23.

<Summary of Developer Discharge from Developer Bag>

(Summary of Discharge from Before Unsealing to During Unsealing)

First, the discharge of the developer from before the unsealing to the time of start of the unsealing will be described. As described above with reference to FIGS. 6 and 7, the sealing member 19 is pulled toward the power application point portion 20*a* (in the arrow D direction), and the developer bag 16 is supported by the fixing portion 18*c*. For that reason, during unsealing, three places consisting of the power application point portion 20*a*, the fixing portion 18*c* of the frame and the place of the bonding portion where the sealing member 19 is peeled and moved in a direction in which these three places are aligned in a rectilinear line in a cross section perpendicular to the rotation shaft of the unsealing member 20. Thus, the position of the openings 35*a* is changed between the time before the unsealing member 20 applies the force to the sealing member 19 to perform the unsealing operation and the time when the unsealing operation is started to unseal the first bonding portion 22*a*, so that stagnation of the developer in the neighborhood of the openings 35*a* can be prevented.

(Summary of Discharge after Unsealing/During Urging)

When the sealing member 19 is unsealed from the above-described developer bag 16 as shown in (b) of FIG. 7, the openings 35*a* are disposed to open at a lower portion of the developer bag 16 and therefore the developer in the neighborhood of the openings 35*a* is discharged by the action of gravitation and vibration or the like of the developer bag 16 during the unsealing.

After the unsealing, when the unsealing member 20 is further rotated, also the urging sheet 21*b* for urging the developer bag 16 fixed to the unsealing member 20 is rotated, so that the distance 21*b* is wound about the unsealing member 20 by the developer bag 16 as shown in FIG. 8. As shown in FIG. 12, the urging sheet 21*b* has elasticity and therefore is likely to be restored to an original shape, thus urging the developer bag 16 in an arrow J direction. At this time, the developer bag 16 is urged by the urging sheet 21*b* and is pressed against the second frame 18 via the toner, so that the entire developer bag 16 is deformed. The developer bag 16 is urged by the urging sheet 21*b* to be decreased in its inside volume. Thus, by the decrease in inside volume of and the change in entire shape of the developer bag 16, the developer inside the developer bag 16 is stirred by these effects, the developer is discharged through the openings 35*a*. At this time, the developer bag 16 is closed except for the openings 35*a* and thus there is no escape route except for the openings 35*a*, and therefore the discharging property from the openings 35*a* is improved. By the discharging action as described above, the developer is discharged in the arrow I direction.

In the case, when the developer bag 16 is contacted to and pressed against the second frame 18 at least at a part thereof, the developer bag 16 is deformed.

By aligning the rotational axis direction of the developing roller 13 and the arrangement direction F of the plurality of openings 35*a*, the developer is easily supplied over the entire longitudinal direction of the developing roller 13 during the discharge without being localized.

When the developing device 38 is mounted in the image forming apparatus main assembly B, by providing the openings 35*a* so as to open toward the direction of gravitation, the developer discharging property is improved.

(Summary of Discharge/Developer Bag Shape Restoration)

As shown in FIG. 13, the unsealing member 20 is further rotated, so that the urging sheet 21*b* is separated from the developer bag 16. At this time, the developer bag 16 has flexibility and therefore is likely to be restored to the state before the urging by the weight of the developer (arrow K direction). Then, also the distance 21*b* is rotated and urges the developer bag 16 toward the second frame 18 as shown in FIG. 16, so that the developer bag 16 is deformed to move the developer at a position other than the neighborhood of the openings 35*a* and thus the developer is discharged from the openings 35*a*.

(Summary of Discharge/Repetition of Unsealing and Restoration)

In the case where the developer immediately after the unsealing is accommodated in the developer bag 16 in a large amount, a penetration depth (entering amount) of the urging sheet 21*b* and the unsealing member 20 is repetitively changed, so that the developer bag 16 is deformed so as to be pressed against the second frame 18. Contraction of the developer bag 16 by the urging with the urging member 21 and restoration of the shape of the developer bag 16 by the weight of the developer inside the developer bag 16 and by the flexibility of the developer bag 16 are repeated. Further, by the above-described action, the developer bag 16 itself is moved and therefore the developer bag 16 is vibrated, so that the developer inside the developer bag 16 is discharged from the openings 35*a* also by the vibration of the developer bag 16. The urging member 21 is rotated and therefore repetitively urges the developer bag 16.

(Case where Amount of Developer is Small)

The case where the amount of the developer inside the developer bag 16 is decreased by image formation will be described with reference to (a) and (b) of FIG. 14. Immediately after the unsealing, as shown in (a) of FIG. 14, the shape of the developer bag 16 follows a shape, defined by the urging member 21, in such a manner that the developer bag 16 always contacts the urging member 21 by the weight of the accommodated developer, so that a size (inside volume) is periodically changed. However, when the amount of the accommodated developer becomes small, as shown in (b) of FIG. 14, the weight of the developer becomes light, so that the developer bag 16 does not follow the urging member 21 and thus repeats periodical separation from and contact with the urging member 21. For that reason, the size (inside volume) of the developer bag 16 is not so changed. For that reason, a developer discharging effect by the change in inside volume of the developer bag 16 is decreased but by the periodical contact between the developer bag 16 and the urging member 21, the developer bag 16 is vibrated and thus the developer is discharged.

As described above, the developer inside the developer bag 16 can be satisfactorily discharged without providing another discharging part such as a developer discharging roller at the openings 35*a* as a developer discharging port, so that agglomeration and bridge of the developer in the neighborhood of the openings 35*a* can be prevented. As a result, even in the case where the developer in the developer bag 16 is agglomerated by tapping during transportation, storage or the like, the agglomerated developer is broken by the movement of the entire developer bag 16 and the periphery of the openings 35*a* as described above, so that it is possible to prevent a state in which it is difficult to discharge the developer.

(Summary of Discharge with Respect to Longitudinal Direction of Developer Accommodating Unit)

Next, a summary of discharge of the developer with respect to the direction F perpendicular to the unsealing direction E of the unsealing member, i.e., with respect to the longitudinal direction of the developer accommodating unit will be described.

First, description will be made with reference to FIG. 15. Part (a) of FIG. 15 is a schematic view of the developing bag as seen from an arrow Z direction indicated in FIG. 3, and is a general view along the longitudinal direction F and is also a schematic simple view of FIG. 9. Part (a) of FIG. 15 shows a structure of the developing bag 16 and is a front view of the developing bag 16. Incidentally, in (a) of FIG. 15, the sealing member 19 and the unsealing member 20 are omitted from illustration.

In (a) of FIG. 15, the plurality of openings 35*a* are formed and arranged along the longitudinal direction F. Further, as described above, the opening area of each of the openings 35*a* is larger at the end portions with respect to the longitudinal direction F than the opening areas of openings 35*x*, 35*w* and the like at the central portion with respect to the longitudinal direction F. That is, the diameter of the circular hole is larger at the longitudinal end portions than at the longitudinal central portion.

In the structure shown in (a) of FIG. 15, the discharge amount of the developer from the developing bag 16 will be shown as a longitudinal distribution diagram in (b) of FIG. 15. In (b) of FIG. 15, the abscissa represents Cartesian coordinate axis, and the ordinate represents the discharge amount per unit time of the developer from the developing bag 16. For example, in (b) of FIG. 15, the developer discharge amount per unit time in a position of a minute section Δ including a center line w-w is the sum of values of the developer discharge amounts through openings 35*w*, 35*x*, 35*y*, 35*z*, . . . in the neighborhood of the center line w-w shown in (a) of FIG. 15. As shown in (b) of FIG. 15, in a constitution in this embodiment shown in (a) of FIG. 15, the developer discharge amount per unit time in the neighborhood of the end portions is approximately equal to that in the neighborhood of the central portion, and therefore the developer discharge amount per unit time can be caused to approach a substantially uniform distribution over the longitudinal direction.

Further, in (c) of FIG. 15, the abscissa represents Cartesian coordinate axis with respect to the longitudinal direction F, and the ordinate represents a residual amount distribution of the developer in the developing bag 16 in the case where the developer in the developing bag 16 becomes small. As shown in (c) of FIG. 15, even in the case where the developer in the developing bag 16 becomes small as shown in (b) of FIG. 14, the longitudinal distribution of the developer remaining in the developing bag 16 is easily maintained in a substantially uniform state over the longitudinal direction F, and therefore also the developer discharge amount from the developing bag 16 in the case where the developer is small can be caused to approach the substantially uniform distribution over the longitudinal direction F.

On the other hand, Comparison example 1 which is not the embodiment of the present invention will be described with reference to FIG. 16. Part (a) of FIG. 16 is a schematic view, of a developing bag, corresponding to the schematic view as seen from an arrow Z direction indicated in FIG. 3, and is a general view along the longitudinal direction F and is also a schematic simple view corresponding to the schematic view of FIG. 9. Part (a) of FIG. 16 shows a structure of the developing bag 16 and is a front view of the developing bag 16. Incidentally, in (a) of FIG. 16, the sealing member 19 and the unsealing member 20 are omitted from illustration.

In (a) of FIG. 16, the plurality of openings 35*a* are formed and arranged along the longitudinal direction F, and the diameters of the circular holes are the same.

In the structure shown in (a) of FIG. 16, the discharge amount of the developer from the developing bag 16 will be shown as a longitudinal distribution diagram in (b) of FIG. 16. In (b) of FIG. 16, similarly as in (b) of FIG. 15, the abscissa represents Cartesian coordinate axis, and the ordinate represents the discharge amount per unit time of the developer from the developing bag 16. In (b) of FIG. 16, the developer discharge amount in the neighborhood of the end portions is smaller than that in the neighborhood of the central portion. As causes of this a first cause is such that by the influence of a wall surface or the like provided in the neighborhood of the end portions, the discharge of the developer is improved at the end portions. A second cause is such that at the end portions of the urging member 21, compared with the central portion of the urging member 21, elasticity is small and an urging effect is small, and therefore a developer discharge accelerating effect is small at the end portions than at the central portion. Therefore, in a constitution in Comparison example 1, which is not the embodiment of the present invention, shown in (a) of FIG. 16, the developer discharge amount per unit time is smaller at the end portions than at the central portion, and therefore the developer discharge amount distribution becomes non-uniform over the longitudinal direction.

Further, with respect to the structure shown in (a) of FIG. 16, in (c) of FIG. 16, the abscissa represents Cartesian coordinate axis with respect to the longitudinal direction F, and the ordinate represents a residual amount distribution of the developer in the developing bag 16 in the case where the developer in the developing bag 16 becomes small. Resulting from the developer discharge amount distribution per unit time shown in (b) of FIG. 16, in the case where the developer in the developing bag 16 becomes small as shown in (b) of FIG. 14, as shown in (c) of FIG. 16, the residual amount of the developer remaining in the developing bag 16 is larger at the end portions than at the central portion with respect to the longitudinal direction F, and therefore the longitudinal distribution of the residual amount of the developer is liable to become non-uniform over the longitudinal direction F.

As a result, in the case where the developer in the developing bag 16 becomes small, the developer discharge amount from the developing bag 16 becomes large at the end portions than in the neighborhood of the central portion, thus being non-uniform over the longitudinal direction F.

As described above, the developer discharge amount from the developing bag 16 becomes non-uniform over the longitudinal direction F, and therefore there is a possibility of generation of image non-uniformity over an image forming region during image formation.

As described above, in the constitution shown in (a) of FIG. 16, compared with the constitution shown in (a) of FIG. 15, the developer discharge amount per unit time shows the non-uniform distribution over the longitudinal direction F throughout a general period from start of use of the developer accommodating unit until the developer accommodating unit reaches an end of a lifetime thereof, and therefore the possibility of generation of image non-uniformity over the image forming region during image formation.

For this reason, in order to reduce a degree of the image non-uniformity by discharging the developer substantially uniformly over the longitudinal direction, compared with the constitution of (a) of FIG. 16 in Comparison example 1, the constitution of (a) of FIG. 15 in Embodiment 1 of the present invention is effective.

Further, Comparison example 2 as another example which is not the embodiment of the present invention will be described with reference to FIG. 17. Part (a) of FIG. 17 is a schematic view, of a developing bag, corresponding to the schematic view as seen from an arrow Z direction indicated in FIG. 3, and is a general view along the longitudinal direction F and is also a schematic simple view corresponding to the schematic view of FIG. 9. Part (a) of FIG. 17 shows a structure of the developing bag 16 and is a front view of the developing bag 16. Incidentally, in (a) of FIG. 17, the sealing member 19 and the unsealing member 20 are omitted from illustration.

In (a) of FIG. 17, the plurality of openings 35*a* are formed and arranged along the longitudinal direction F, and the diameters of the circular holes are the same. In addition, in (a) of FIG. 17, the circular hole diameters of the openings 35*a* are larger than those in the constitution of (a) of FIG. 16 in Comparison example 1 described above and are equal to those at the end portions in the constitution of (a) of FIG. 15 in Embodiment 1 of the present invention.

In the structure shown in (a) of FIG. 17, the discharge amount of the developer from the developing bag 16 will be shown as a longitudinal distribution diagram in (b) of FIG. 17. In (b) of FIG. 17, similarly as in (b) of FIG. 15 and (b) of FIG. 16, the abscissa represents Cartesian coordinate axis, and the ordinate represents the discharge amount per unit time of the developer from the developing bag 16. In (b) of FIG. 17, similarly as in (b) of FIG. 16, the developer discharge amount in the neighborhood of the end portions is smaller than that in the neighborhood of the central portion.

Further, also in a constitution in Comparison example 2 which is not the embodiments of the present invention, shown in (a) of FIG. 17, similarly as in the constitution of (a) of FIG. 16, the developer discharge amount per unit time is smaller at the end portions than at the central portion, and therefore the developer discharge amount distribution becomes non-uniform over the longitudinal direction.

Further, with respect to the structure shown in (a) of FIG. 17, in (c) of FIG. 17, the abscissa represents Cartesian coordinate axis with respect to the longitudinal direction F, and the ordinate represents a residual amount distribution of the developer in the developing bag 16 in the case where the developer in the developing bag 16 becomes small. Resulting from the developer discharge amount distribution per unit time shown in (b) of FIG. 17, in the case where the developer in the developing bag 16 becomes small as shown in (b) of FIG. 14, as shown in (c) of FIG. 17, the residual amount of the developer remaining in the developing bag 16 is larger at the end portions than at the central portion with respect to the longitudinal direction F, and therefore the longitudinal distribution of the residual amount of the developer is liable to become non-uniform over the longitudinal direction F.

As a result, in the case where the developer in the developing bag 16 becomes small, the developer discharge amount from the developing bag 16 becomes large at the end portions than in the neighborhood of the central portion, thus being non-uniform over the longitudinal direction F.

As described above, the developer discharge amount from the developing bag 16 becomes non-uniform over the longitudinal direction F, and therefore there is a possibility of generation of image non-uniformity over an image forming region during image formation.

As described above, also in the constitution shown in (a) of FIG. 17, compared with the constitution shown in (a) of FIG. 15, the developer discharge amount per unit time shows the non-uniform distribution over the longitudinal direction F throughout a general period from start of use of the developer accommodating unit until the developer accommodating unit reaches an end of a lifetime thereof, and therefore the possibility of generation of image non-uniformity over the image forming region during image formation.

For this reason, in order to reduce a degree of the image non-uniformity by discharging the developer substantially uniformly over the longitudinal direction, compared with the constitution of (a) of FIG. 17 in Comparison example 1, the constitution of (a) of FIG. 15 in Embodiment 1 of the present invention is effective.

<Summary>

As described above, the plurality of openings 35*a* are formed and arranged in the longitudinal direction F, and the opening area of each of the openings 35*a* is such that the opening area of the openings provided at the end portions with respect to the longitudinal direction F is larger than the opening area of the openings provided at the central portion with respect to the longitudinal direction F. That is, the circular hole diameter is larger at the end portions than at the central portion with respect to the longitudinal direction F. By employing such a constitution, the developer discharge amount from the developing bag 16 can be caused to approach a substantially uniform distribution.

Further, also in the case where the developer amount becomes small, the longitudinal distribution of the developer remaining in the developing bag 16 can be caused to approach the substantially uniform state over the longitudinal direction F, and therefore even in the case where the developer amount is small, the developer discharge amount from the developing bag 16 can be caused to approach the substantially uniform state.

As described above, when the image is formed over the general period from the start of use of the developer accommodating unit until the developer accommodating unit reaches the end of the lifetime thereof, a degree of the generation of the image non-uniformity can be reduced over the image forming region.

[Embodiment 2]

Embodiment 2 of the present invention will be described with reference to FIG. 18. Elements having the same or corresponding constitutions and actions as those in Embodiment 1 are represented by the same reference numerals or symbols and will be omitted from detailed description.

Figure 18:
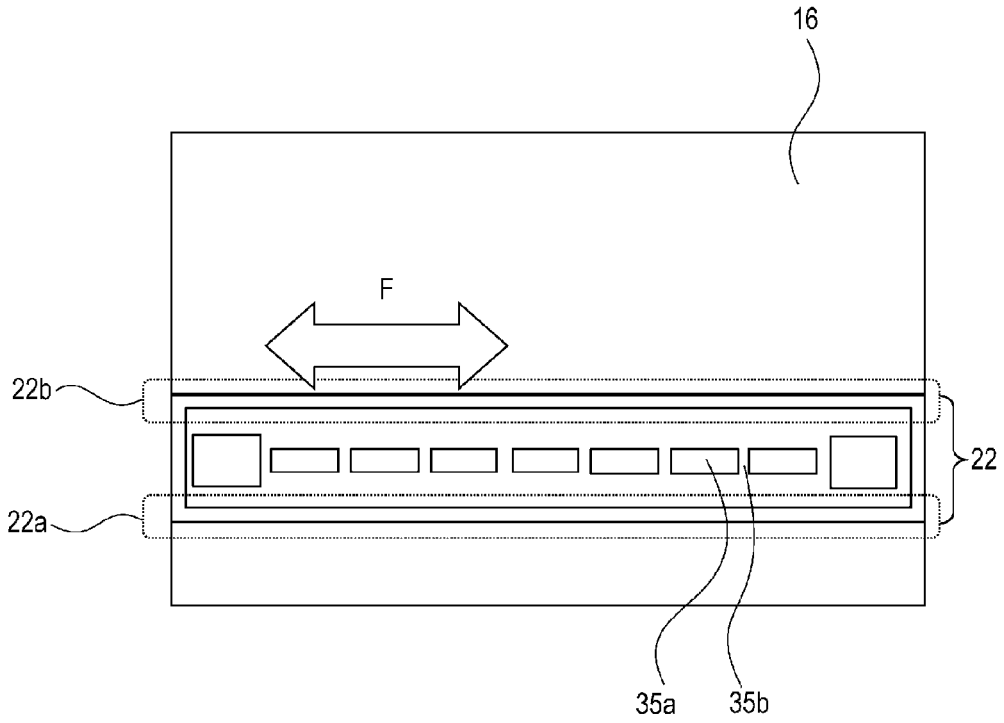

FIG. 18 is a schematic view corresponding to a schematic view of the developing bag as seen from an arrow Z direction indicated in FIG. 3, and is a general view along the longitudinal direction F and is also a schematic view corresponding to a schematic simple view of FIG. 9. FIG. 18 shows a structure of the developing bag 16 and is a front view of the developing bag 16. Incidentally, in FIG. 18, the sealing member 19 and the unsealing member 20 are omitted from illustration.

In FIG. 18, the plurality of openings 35*a* are formed and arranged along the longitudinal direction F similarly as in Embodiment 1. Further, a maximum width, of the plurality of openings 35*a*, with respect to a direction perpendicular to the longitudinal direction is larger for the openings at the longitudinal end portions than for the openings at the longitudinal central portion. Also in the constitution of FIG. 18, similarly as the effect described in Embodiment 1, the developer discharge amount from the developing bag 16 can be caused to approach a substantially uniform distribution. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

[Embodiment 3]

Embodiment 3 of the present invention will be described with reference to FIG. 19. Elements having the same or corresponding constitutions and actions as those in Embodiment 1 are represented by the same reference numerals or symbols and will be omitted from detailed description.

Figure 19:
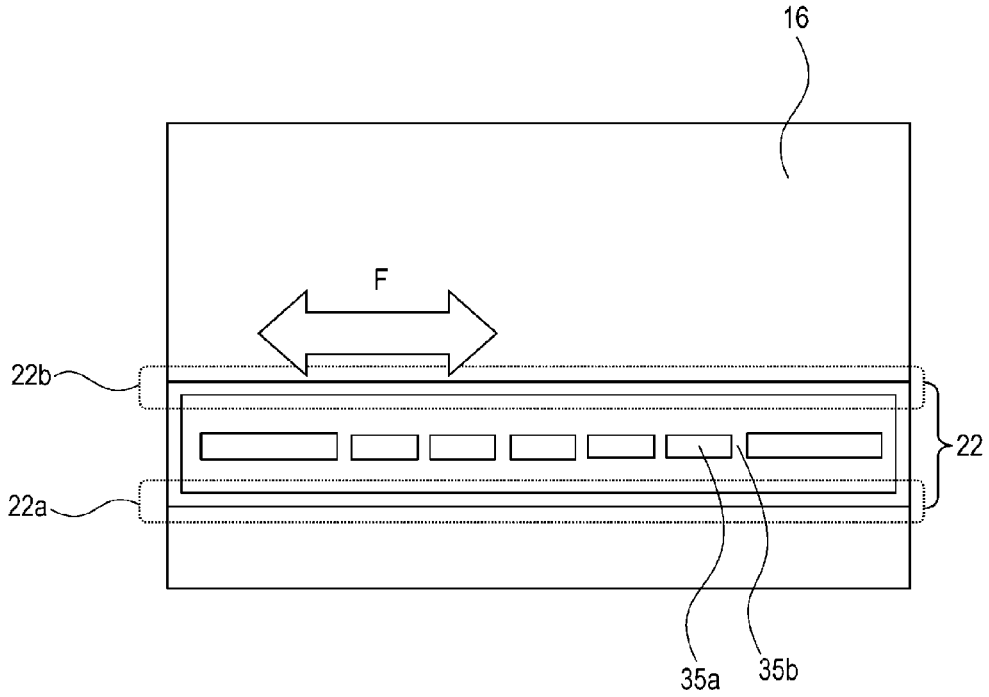

FIG. 19 is a schematic view corresponding to a schematic view of the developing bag as seen from an arrow Z direction indicated in FIG. 3, and is a general view along the longitudinal direction F and is also a schematic view corresponding to a schematic simple view of FIG. 9. FIG. 19 shows a structure of the developing bag 16 and is a front view of the developing bag 16. Incidentally, in FIG. 19, the sealing member 19 and the unsealing member 20 are omitted from illustration.

In FIG. 19, a maximum width, of the plurality of openings 35*a*, with respect to the longitudinal direction is larger for the openings at the longitudinal end portions than for the openings at the longitudinal central portion. Also in the constitution of FIG. 19, similarly as the effect described in Embodiment 1, the developer discharge amount from the developing bag 16 can be made a substantially uniform. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

[Embodiment 4]

Embodiment 4 of the present invention will be described with reference to FIG. 20. Elements having the same or corresponding constitutions and actions as those in Embodiment 1 are represented by the same reference numerals or symbols and will be omitted from detailed description.

Figure 20:
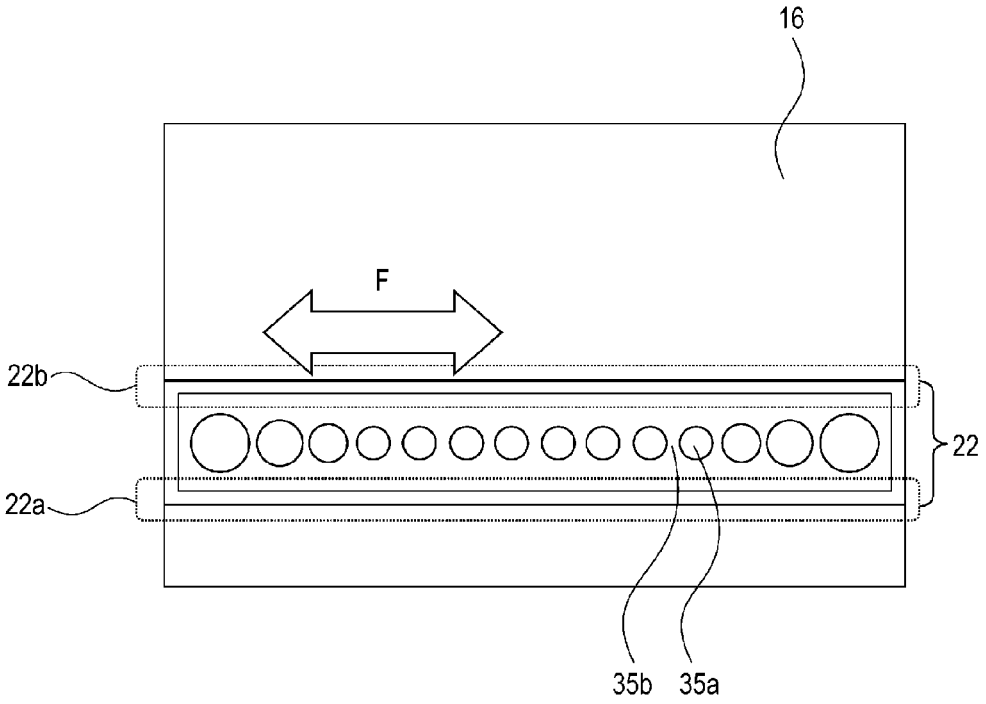

FIG. 20 is a schematic view corresponding to a schematic view of the developing bag as seen from an arrow Z direction indicated in FIG. 3, and is a general view along the longitudinal direction F and is also a schematic view corresponding to a schematic simple view of FIG. 9. FIG. 20 shows a structure of the developing bag 16 and is a front view of the developing bag 16. Incidentally, in FIG. 20, the sealing member 19 and the unsealing member 20 are omitted from illustration.

In FIG. 20, the opening areas of the openings 35*a* at the longitudinal end portions are stepwisely increased along a direction from the central portion toward the end portions with respect to the longitudinal direction. Also in the constitution of FIG. 20, similarly as the effect described in Embodiment 1, the developer discharge amount from the developing bag 16 can be made a substantially uniform. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

Incidentally, in the constitution in this embodiment, at the openings at the longitudinal central portion where the opening area is smaller than the opening areas of the openings at the longitudinal end portions, the opening areas of the openings are the same. The number of the openings where the opening areas are the same may be appropriately set, but in particular, the constitution in this embodiment is effective in the developer accommodating unit in which a longitudinal length of the discharging portion is long.

[Embodiment 5]

Embodiment 5 of the present invention will be described with reference to FIG. 21. Elements having the same or corresponding constitutions and actions as those in Embodiment 1 are represented by the same reference numerals or symbols and will be omitted from detailed description.

Figure 21:
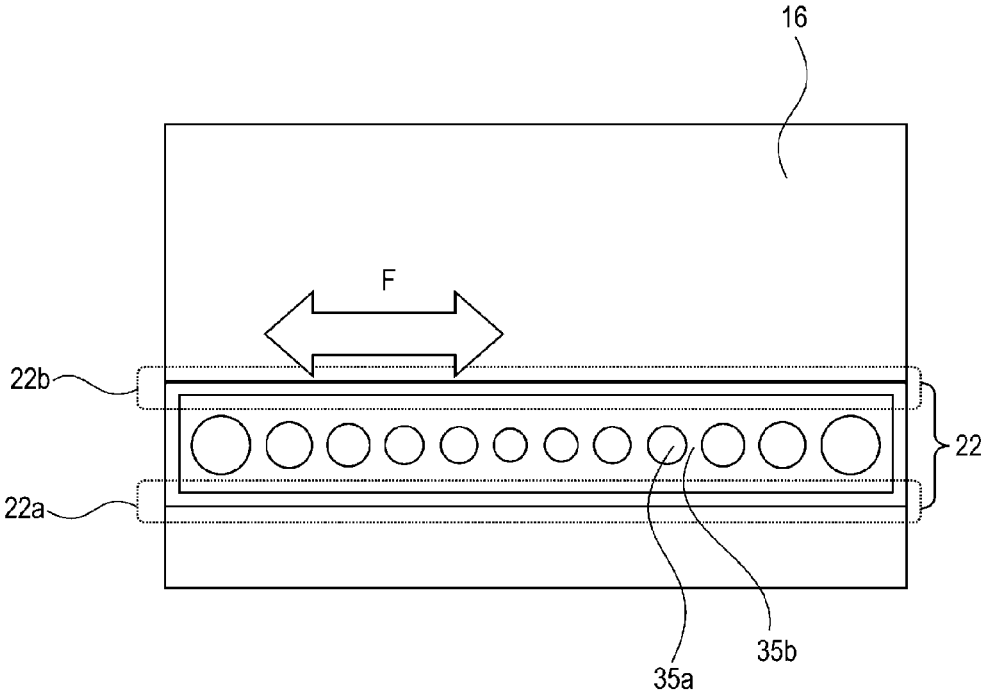

FIG. 21 is a schematic view corresponding to a schematic view of the developing bag as seen from an arrow Z direction indicated in FIG. 3, and is a general view along the longitudinal direction F and is also a schematic view corresponding to a schematic simple view of FIG. 9. FIG. 21 shows a structure of the developing bag 16 and is a front view of the developing bag 16. Incidentally, in FIG. 21, the sealing member 19 and the unsealing member 20 are omitted from illustration.

In FIG. 21, the opening areas of the openings 35*a* are stepwisely increased along a direction from the central portion toward the end portions with respect to the longitudinal direction. Also in the constitution of FIG. 21, similarly as the effect described in Embodiment 1, the developer discharge amount from the developing bag 16 can be made a substantially uniform. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

[Embodiment 6]

In Embodiment 1, the developer discharging portion 35 is unsealed in the direction substantially perpendicular to the longitudinal direction F of the developer accommodating unit 25, but in this embodiment, as shown in FIG. 22, the developer discharging portion 35 may also be unsealed in the direction substantially parallel to the longitudinal direction F of the developer accommodating unit 25. Incidentally, in FIG. 22, the unsealing member 20 and the fixing portion 16*a* of the developing bag 16 are not illustrated.

In the case of this constitution, Embodiment 6 of the present invention will be described with reference to FIG. 23. Elements having the same or corresponding constitutions and actions as those in Embodiment 1 are represented by the same reference numerals or symbols and will be omitted from detailed description.

Figure 23:
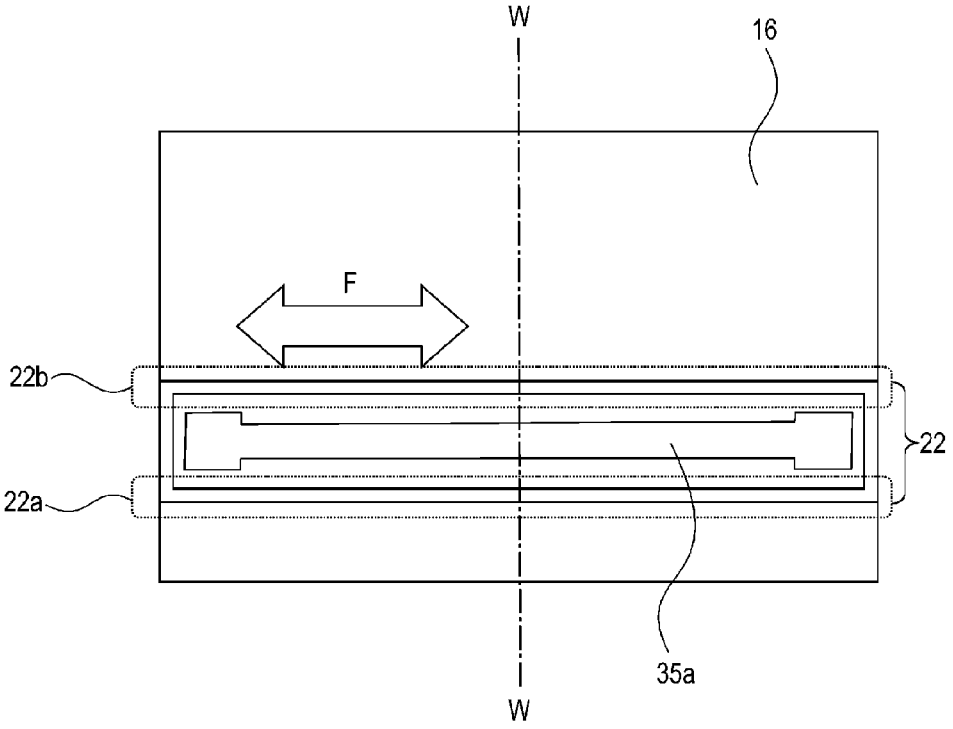

FIG. 23 is a schematic view of the developing bag as seen from an arrow X direction, substantially perpendicular to the longitudinal direction F, indicated in FIG. 22, and is a general view along the longitudinal direction F. FIG. 23 shows a structure of the developing bag 16 and is a front view of the developing bag 16. Incidentally, in FIG. 23, the sealing member 19 and the unsealing member 20 are omitted from illustration. Incidentally, a center line w-w indicated in FIG. 23 shows the center of the longitudinal direction F described below.

In FIG. 23, the openings 35*a* are formed along the longitudinal direction F of the developer accommodating unit 25. Further, a width of the openings 35*a* with respect to the direction crossing the longitudinal direction F is larger at the longitudinal end portions than at the longitudinal central portion. Also in the constitution of FIG. 23, similarly as the effect described in Embodiment 1, the developer discharge amount from the developing bag 16 can be made substantially uniform. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

[Embodiment 7]

In the case where similarly as in Embodiment 6, the developer discharging portion is unsealed in the direction substantially parallel to the longitudinal direction F of the developer accommodating unit as shown in FIG. 22, Embodiment 7 of the present invention will be described with reference to FIG. 24. Elements having the same or corresponding constitutions and actions as those in Embodiment 1 are represented by the same reference numerals or symbols and will be omitted from detailed description.

Figure 24:
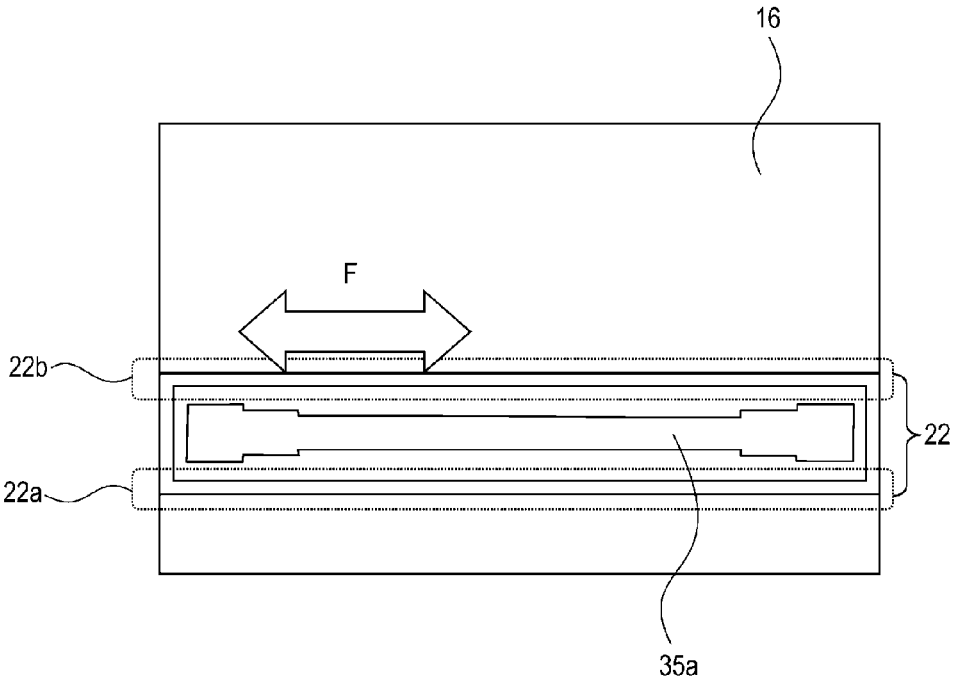

FIG. 24 is a schematic view corresponding to the schematic view of the developing bag as seen from an arrow X direction, substantially perpendicular to the longitudinal direction F, indicated in FIG. 22, and is a general view along the longitudinal direction F. FIG. 24 shows a structure of the developing bag 16 and is a front view of the developing bag 16. Incidentally, in FIG. 24, the sealing member 19 and the unsealing member 20 are omitted from illustration.

In FIG. 24, the openings 35*a* are formed along the longitudinal direction F of the developer accommodating unit 25. Further, at the longitudinal end portions, a width of the openings 35*a* with respect to the direction crossing the longitudinal direction F is stepwisely increased along a direction from the longitudinal central portions toward the longitudinal end portions. Also in the constitution of FIG. 24, similarly as the effect described in Embodiment 1, the developer discharge amount from the developing bag 16 can be caused to approach the substantially uniform distribution. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

[Embodiment 8]

In the case where similarly as in Embodiment 6, the developer discharging portion is unsealed in the direction substantially parallel to the longitudinal direction F of the developer accommodating unit as shown in FIG. 22, Embodiment 8 of the present invention will be described with reference to FIG. 25. Elements having the same or corresponding constitutions and actions as those in Embodiment 1 are represented by the same reference numerals or symbols and will be omitted from detailed description.

Figure 25:
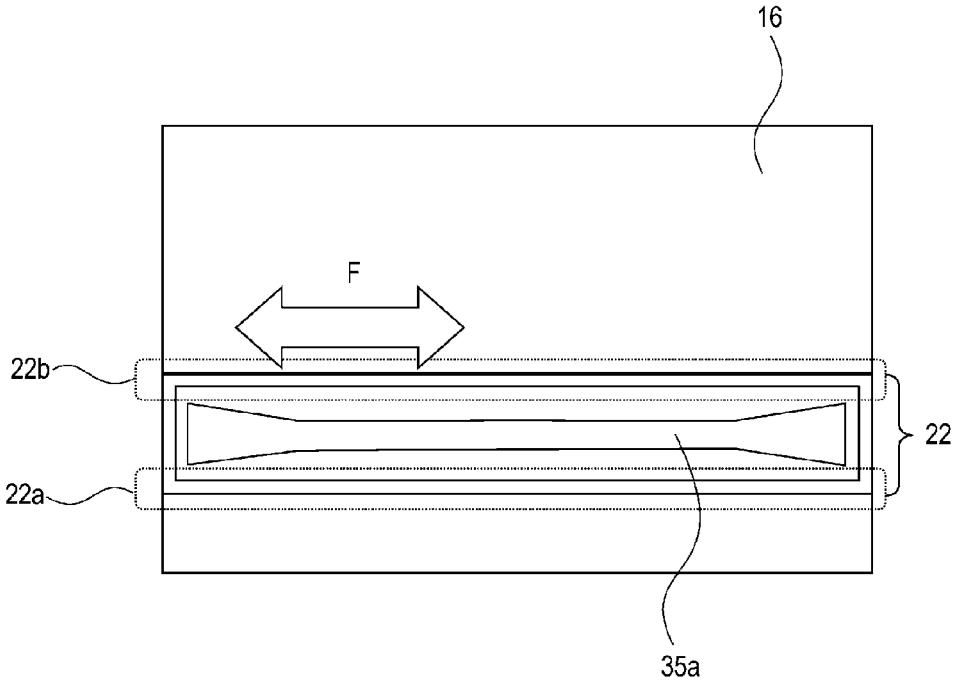

FIG. 25 is a schematic view corresponding to the schematic view of the developing bag as seen from an arrow X direction, substantially perpendicular to the longitudinal direction F, indicated in FIG. 22, and is a general view along the longitudinal direction F. FIG. 25 shows a structure of the developing bag 16 and is a front view of the developing bag 16. Incidentally, in FIG. 25, the sealing member 19 and the unsealing member 20 are omitted from illustration.

In FIG. 25, the openings 35*a* are formed along the longitudinal direction F of the developer accommodating unit 25. Further, at the longitudinal end portions, a width of the openings 35*a* with respect to the direction crossing the longitudinal direction F is continuously increased along a direction from the longitudinal central portions toward the longitudinal end portions. Also in the constitution of FIG. 25, similarly as the effect described in Embodiment 1, the developer discharge amount from the developing bag 16 can be caused to approach the substantially uniform distribution. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

[Embodiment 9]

In the case where similarly as in Embodiment 6, the developer discharging portion is unsealed in the direction substantially parallel to the longitudinal direction F of the developer accommodating unit as shown in FIG. 22, Embodiment 9 of the present invention will be described with reference to FIG. 26. Elements having the same or corresponding constitutions and actions as those in Embodiment 1 are represented by the same reference numerals or symbols and will be omitted from detailed description.

Figure 26:
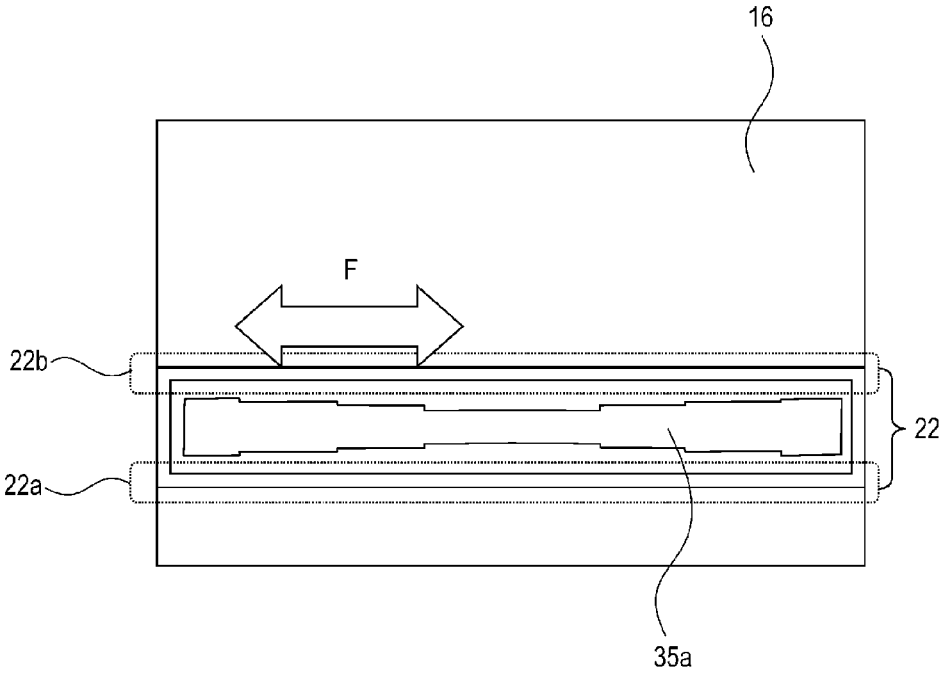

FIG. 26 is a schematic view corresponding to the schematic view of the developing bag as seen from an arrow X direction, substantially perpendicular to the longitudinal direction F, indicated in FIG. 22, and is a general view along the longitudinal direction F. FIG. 26 shows a structure of the developing bag 16 and is a front view of the developing bag 16. Incidentally, in FIG. 26, the sealing member 19 and the unsealing member 20 are omitted from illustration.

In FIG. 26, the openings 35*a* are formed along the longitudinal direction F of the developer accommodating unit 25. Further, a width of the openings 35*a* with respect to the direction crossing the longitudinal direction F is stepwisely increased along a direction from the longitudinal central portions toward the longitudinal end portions. Also in the constitution of FIG. 26, similarly as the effect described in Embodiment 1, the developer discharge amount from the developing bag 16 can be caused to approach the substantially uniform distribution. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

[Embodiment 10]

In the case where similarly as in Embodiment 6, the developer discharging portion is unsealed in the direction substantially parallel to the longitudinal direction F of the developer accommodating unit as shown in FIG. 22, Embodiment 10 of the present invention will be described with reference to FIG. 27. Elements having the same or corresponding constitutions and actions as those in Embodiment 1 are represented by the same reference numerals or symbols and will be omitted from detailed description.

Figure 27:
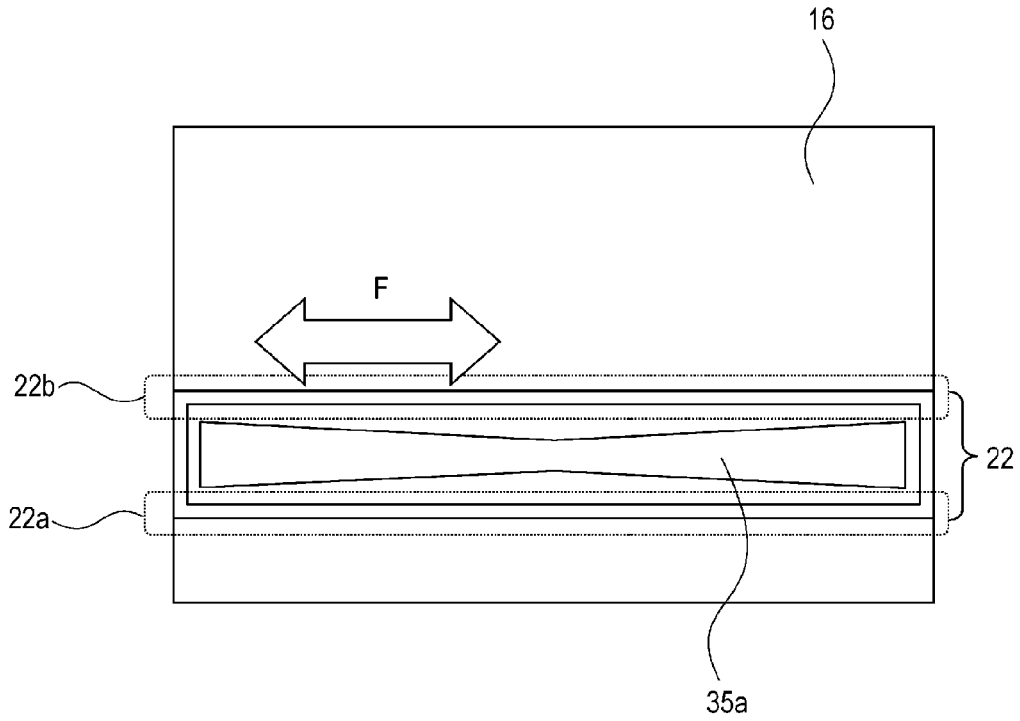

FIG. 27 is a schematic view corresponding to the schematic view of the developing bag as seen from an arrow X direction, substantially perpendicular to the longitudinal direction F, indicated in FIG. 22, and is a general view along the longitudinal direction F. FIG. 27 shows a structure of the developing bag 16 and is a front view of the developing bag 16. Incidentally, in FIG. 27, the sealing member 19 and the unsealing member 20 are omitted from illustration.

In FIG. 27, the openings 35*a* are formed along the longitudinal direction F of the developer accommodating unit 25. Further, a width of the openings 35*a* with respect to the direction crossing the longitudinal direction F is continuously increased along a direction from the longitudinal central portions toward the longitudinal end portions. Also in the constitution of FIG. 26, similarly as the effect described in Embodiment 1, the developer discharge amount from the developing bag 16 can be caused to approach the substantially uniform distribution. Further, also in the case where the developer amount becomes small, the longitudinal distribution of the developer remaining in the developing bag 16 is easily maintained in the substantially uniform state over the longitudinal direction F, and therefore even in the case where the developer amount is small, the developer discharge amount from the developing bag 16 can be caused to approach the substantially uniform state with respect to the longitudinal direction.

As a result, when the image is formed over the general period from the start of use of the developer accommodating unit until the developer accommodating unit reaches the end of the lifetime thereof, a degree of the generation of the image non-uniformity can be reduced over the image forming region.

REFERENCE EXAMPLE

Here, a reference example will be described with reference to FIG. 29. For the purpose of improving the unsealing characteristic of the sealing member for sealing the openings of the deformable developer accommodating container, it would be considered that a constitution shown in FIG. 29 is employed. In this constitution, as shown in FIG. 29, a plurality of openings for permitting discharge of the accommodated developer from the developer accommodating container 16 are arranged in the longitudinal direction of the container. Further, before unsealing ((a) of FIG. 29), the sealing member 19 is mounted to the developer accommodating container 26 in a state in which the openings 35*a* are sealed with the sealing member 19, and during unsealing ((b) of FIG. 29), the sealing member 19 is moved to expose the openings 35*a*. The openings 35*a* are arranged and shifted along a direction perpendicular to the unsealing direction in which exposure of the openings 35*a* advances. By this constitution, a degree of large deformation of the openings can be reduced, so that it is possible to improve the unsealing characteristic of the sealing member 19 for sealing the openings of the deformable developer accommodating container 26.

At the longitudinal end portions of the developer accommodating unit, the discharge amount per unit time of the developer discharged from the deformable developer accommodating container is smaller than at the longitudinal central portion and therefore, there is a possibility that uniformity of the developer discharge amount per unit time with respect to the longitudinal direction of the container cannot be maintained at a high level. In addition, in the case where the developer remaining in the container is small, at the longitudinal end portions, the discharge amount per unit time is larger than at the longitudinal central portion, and therefore there is possibility that also in this case, the uniformity of the developer discharge amount distribution with respect to the longitudinal direction of the container cannot be maintained at the high level.

As is understood from the above, the usefulness of the constitutions in the embodiments described above is high.

According to the present invention, the developer discharge amount distribution with respect to the longitudinal direction of the flexible container can be caused to approach the uniform state, and even in the case where the developer remaining in the flexible container is small in amount, the longitudinal discharge amount distribution of the developer in the flexible container can be caused to approach the uniform state. That is, the longitudinal discharge amount distribution of the developer in the flexible container can be caused to approach the uniform state over the general period from the start of use of the developer accommodating unit until the developer accommodating unit reaches the end of the lifetime of the developer accommodating unit, so that it is possible to reduce a degree of generation of the image non-uniformity over the image forming region.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 003946/2013 filed Jan. 11, 2013, which is hereby incorporated by reference.

What is claimed is:

1. A developer accommodating unit comprising:

a flexible container provided with a plurality of openings for permitting discharge of developer; and a sealing member for sealing said plurality of openings, wherein openings of said plurality of openings are arranged adjacent to each other along a length direction of said flexible container, wherein said plurality of opening includes a first opening provided adjacent to an end of said flexible container and a second opening provided at a central region along the length direction of said flexible container, wherein an area of said first opening is larger than an area of said second opening, and wherein, when said sealing member is unsealed, said flexible container is deformed to change shapes of said openings.

2. A developer accommodating unit according to claim 1, wherein with respect to the length direction of said flexible container, the areas of opening provided at end are larger than the opening area of said second opening provided at the central region.

3. A developer accommodating unit according to claim 1, wherein said first opening has a maximum width, with respect to a direction to the length, that is larger than a maximum width of said second opening.

4. A developer accommodating unit according to claim 1, wherein said first opening has a maximum length, with respect to the length direction of said flexible container, that is larger than a maximum length of said second opening.

5. A developer accommodating unit according to claim 1, wherein areas of openings of said plurality of openings that are provided at the central region along the length of said flexible container are smaller that areas of opening of said plurality of openings provided that are provided at ends of said flexible container.

6. A developer accommodating unit according to claim 1, wherein the areas of said plurality of opening areas are increasingly larger in a direction from the central region toward the end with respect to the length direction of said flexible container.

7. A developing device comprising:

a developer carrying member for developing, with a developer, a latent image formed on an image bearing member; and a developer accommodating unit according to claim 1.

8. A process cartridge detachably mountable to an image forming apparatus, the process cartridge comprising:

an image bearing member;

a developer carrying member for developing, with a developer, a latent image formed on said image bearing member; and a developer accommodating unit according to claim 1.

9. An image forming apparatus comprising:

feeding means for feeding a recording material;

an image bearing member;

a developer carrying member for developing, with a developer, a latent image formed on said image bearing member; and a developer accommodating unit according to claim 1.

10. A developer accommodating unit comprising:

a flexible container provided with an opening for permitting discharge of developer, said opening extending in a first direction and in a second direction perpendicular to the first direction; and a sealing member for sealing said opening, wherein said opening has a length in the first direction that is longer than any width of said opening in the second direction, wherein a first width in the second direction of said opening at an end of said opening in the first direction is larger than a second width in the second direction of said opening at a central region of said opening in the first direction, and wherein, when said sealing member is unsealed, said flexible container is deformed to change a shape of said opening.

11. A developer accommodating unit according to claim 10, wherein width of the opening with respect to the second direction are larger at end portions with respect to the first direction than at the central region with respect to the first direction.

12. A developer accommodating unit according to claim 10, wherein the first direction is perpendicular to the unsealing direction of said sealing member.

13. A developer accommodating unit according to claim 10, wherein at the end portion with respect to the first direction, the width of the opening in the second direction is stepped or continuously increased in a direction from the central region toward the end portion with respect to the first direction.

14. A developer accommodating unit according to claim 10, wherein the width of the opening with respect to the second direction is stepped or continuously increased in a direction from the central portion toward the end portion with respect to the first direction.

15. A developing device comprising:

a developer carrying member for developing, with developer, a latent image formed on an image bearing member; and a developer accommodating unit according to claim 10.

16. A process cartridge detachably mountable to an image forming apparatus, the process cartridge comprising:

an image bearing member;

a developer carrying member for developing, with developer, a latent image formed on said image bearing member; and a developer accommodating unit according to claim 10.

17. An image forming apparatus comprising:

feeding means for feeding a recording material;

an image bearing member;

a developer carrying member for developing, with developer, a latent image formed on said image bearing member; and a developer accommodating unit according to claim 10.

* * * * *